US008276517B2

(12) United States Patent
Poleg et al.

(10) Patent No.: US 8,276,517 B2
(45) Date of Patent: Oct. 2, 2012

(54) METHOD, DEVICE AND SYSTEM OF DEPLOYING A PAYLOAD

(75) Inventors: Zvi Poleg, Natanya (IL); Dov Herskowits, Petach-Tikwa (IL); Shalom Grossman, Hadera (IL)

(73) Assignee: E.M.I. (1997) Ltd., Zichron Yaacov (IL)

( * ) Notice: Subject to any disclaimer, the term of this patent is extended or adjusted under 35 U.S.C. 154(b) by 231 days.

(21) Appl. No.: 12/452,669

(22) PCT Filed: Jul. 16, 2007

(86) PCT No.: PCT/IL2007/000890

§ 371 (c)(1),
(2), (4) Date: Jan. 14, 2010

(87) PCT Pub. No.: WO2009/010946

PCT Pub. Date: Jan. 22, 2009

(65) Prior Publication Data

US 2010/0162914 A1 Jul. 1, 2010

(51) Int. Cl.
*F42D 1/10* (2006.01)

(52) U.S. Cl. ..... 102/313; 102/301; 102/324

(58) Field of Classification Search ..... 102/323, 102/324, 325, 326, 327, 328, 329, 330, 313, 102/301

See application file for complete search history.

(56) References Cited

U.S. PATENT DOCUMENTS

| | | | | |
|---|---|---|---|---|
| 3,696,703 | A * | 10/1972 | Fox | 86/20.15 |
| 4,040,330 | A | 8/1977 | Matzen | |
| 4,090,447 | A | 5/1978 | Johnsen | |
| 4,572,075 | A | 2/1986 | Day et al. | |
| 4,813,358 | A | 3/1989 | Roberts | |
| 5,092,245 | A * | 3/1992 | Douglas et al. | 102/324 |

OTHER PUBLICATIONS

International Search Report for PCT/IL2007/000890 dated Aug. 27. 2008.

* cited by examiner

*Primary Examiner* — James Bergin
(74) *Attorney, Agent, or Firm* — Eitan Mehulal & Sadot

(57) ABSTRACT

Some demonstrative embodiments of the invention include a method, device and/or system of deploying a payload. In some demonstrative embodiments, the system may include an invertible sleeve capable of being expanded in an inside-out manner, wherein first and second surfaces of the sleeve, which face outward and inward, respectively, when the sleeve is at an unexpanded state, face inward and outward, respectively, when the sleeve is at an expanded state; a payload conveyer to convey the payload, wherein the payload conveyer is detachably connectable to a first end of the sleeve; and a pressurizer to expand the sleeve by applying a pressure through a second end of the sleeve. Other embodiments are described and claimed.

27 Claims, 15 Drawing Sheets

Fig. 6A
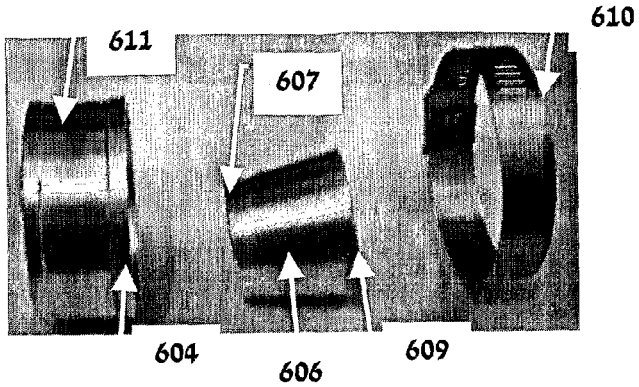
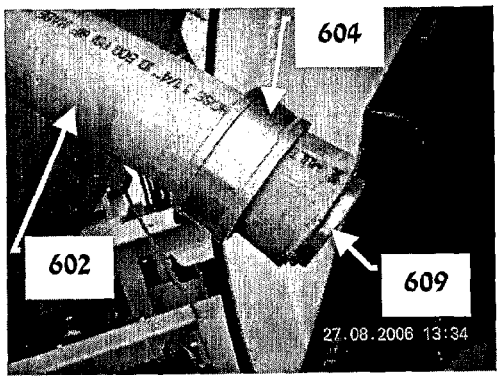
Fig. 6B
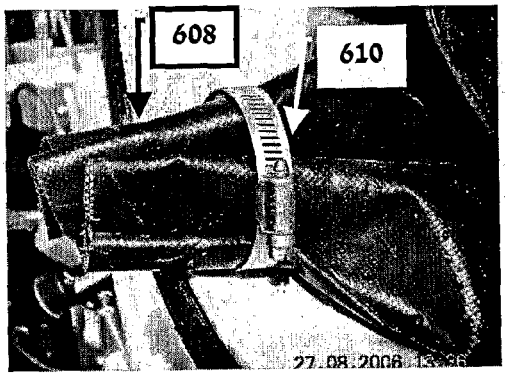
Fig. 6C
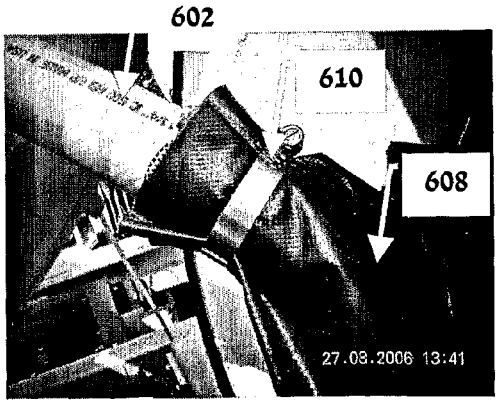
Fig. 6D
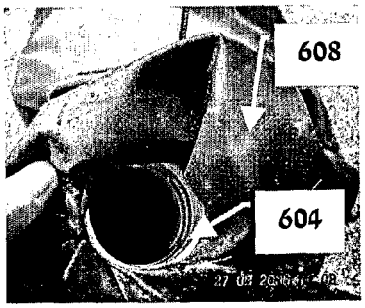
Fig. 6E

METHOD, DEVICE AND SYSTEM OF DEPLOYING A PAYLOAD

PRIOR APPLICATION DATA

This patent application is a National Phase filing of, and claims priority and benefit from, PCT International Patent Application Number PCT/IL2007/000890, titled "Method, Device and System of Deploying a Payload", filed on Jul. 16, 2007, published on Jan. 22, 2009, as International Publication Number WO 2009/010946, which is hereby incorporated by reference in its entirety.

FIELD

Some embodiments of the invention relate generally to deploying a payload and, more particularly, to deploying a payload using an invertible sleeve.

BACKGROUND

Various deployment methods and systems may be used to deploy various payloads at various, locations.

In some implementations a payload may be deployed manually, e.g., by a person, which may carry and/or place the payload at a desired destination.

In other implementations, a payload may be remotely deployed using any suitable deployment device and/or system. For example, a remotely controlled robot may be used to carry and/or place the payload.

SUMMARY

Some demonstrative embodiments of the invention include a method, device and/or system of deploying a payload.

According to some demonstrative embodiments of the invention, a system for deploying a payload may include an invertible sleeve capable of being expanded in an inside-out manner, wherein at least part of first and second surfaces of the sleeve, which face outward and inward, respectively, when the sleeve is at an unexpanded state, face inward and outward, respectively, when the sleeve is at an expanded state; a payload conveyer to convey the payload, wherein the payload conveyer is detachably connectable to a first end of the sleeve; and a pressurizer to expand the sleeve by applying a pressure to a second end of the sleeve.

According to some demonstrative embodiments of the invention, the payload may include a fluid substance, and the payload conveyer may include a hose.

According to some demonstrative embodiments of the invention, the system may include a detachable connector to be connected to the first end of the sleeve and an end of the hose, and to be detached from the end of the hose.

According to some demonstrative embodiments of the invention, the connector is to be detached from the end of the hose when a predefined pressure is applied through the hose.

According to some demonstrative embodiments of the invention, the fluid substance may include a fluid explosive.

According to some demonstrative embodiments of the invention, the fluid explosive may include an emulsion explosive.

According to some demonstrative embodiments of the invention, a diameter of the sleeve is equal to or bigger than a critical diameter of the emulsion explosive.

According to some demonstrative embodiments of the invention, the fluid substance may include a viscous substance having a viscosity of at least 15,000 centipoises.

According to some demonstrative embodiments of the invention, the payload conveyer may include a deployment line.

According to some demonstrative embodiments of the invention, the system may include a detachable connector to be connected to the deployment line and the first end of the sleeve, and to be detached from the first end of the sleeve.

According to some demonstrative embodiments of the invention, the connector may include an attachment mechanism to attach the connector to an object.

According to some demonstrative embodiments of the invention, the sleeve may have a length of at least 25 meters.

According to some demonstrative embodiments of the invention, the pressurizer may include an outlet connectable to the second end of the sleeve.

According to some demonstrative embodiments of the invention, the pressurizer is to expand the sleeve by introducing compressed air through the second end of the sleeve.

According to some demonstrative embodiments of the invention, a method of deploying a payload may include connecting a first end of an invertible sleeve to a payload conveyer; expanding the sleeve in an inside-out manner by applying a pressure to a second end of the sleeve, wherein at least part of first and second surfaces of the sleeve, which face outward and inward, respectively, when the sleeve is at an unexpanded state, face inward and outward, respectively, when the sleeve is at an expanded state; detaching the payload conveyer from the first end of the sleeve; and deploying the payload via the payload conveyer.

According to some demonstrative embodiments of the invention, the payload conveyer may include a hose, and deploying the payload may include deploying a fluid substance through the hose.

According to some demonstrative embodiments of the invention, the method may include retracting the hose.

According to some demonstrative embodiments of the invention, deploying the fluid substance may include deploying a fluid explosive.

According to some demonstrative embodiments of the invention, deploying the fluid explosive may include deploying an emulsion explosive.

According to some demonstrative embodiments of the invention, the method may include connecting to the first end of the sleeve a detonation wire to detonate the explosive fluid.

According to some demonstrative embodiments of the invention, detaching the payload conveyer from the sleeve may include applying a pressure through the hose.

According to some demonstrative embodiments of the invention, the payload conveyer may include a deployment line, and deploying the payload may include deploying the payload over the deployment line.

According to some demonstrative embodiments of the invention, the method may include attaching the deployment line to an object after expanding the sleeve.

According to some demonstrative embodiments of the invention, connecting the first end of the sleeve to the payload conveyer may include connecting the first and of the sleeve and the payload conveyer to a connector. Detaching the payload conveyer from the first end of the sleeve may include detaching the connector from at least one of the first end of the sleeve and the payload conveyer.

According to some demonstrative embodiments of the invention, expanding the sleeve may include expanding the sleeve within a subterranean tunnel.

According to some demonstrative embodiments of the invention, expanding the sleeve may include expanding the sleeve aboveground.

According to some demonstrative embodiments of the invention, deploying the payload may include deploying the payload at one or more locations along an expansion path of the sleeve.

According to some demonstrative embodiments of the invention, deploying the payload may include deploying the payload externally to the sleeve.

According to some demonstrative embodiments of the invention, deploying the payload may include deploying the payload within the sleeve.

BRIEF DESCRIPTION OF THE DRAWINGS

For simplicity and clarity of illustration, elements shown in the figures have not necessarily been drawn to scale. For example, the dimensions of some of the elements may be exaggerated relative to other elements for clarity of presentation. Furthermore, reference numerals may be repeated among the figures to indicate corresponding or analogous elements. Moreover, some of the blocks depicted in the drawings may be combined into a single function. The figures are listed below.

FIG. 6A depicts a detachable connector assembly, in accordance with one demonstrative embodiment of the invention;

FIGS. 6B, 6C, and 6D depict three respective stages of connecting an end of a sleeve to a hose using the connector assembly of FIG. 6A, in accordance with some demonstrative embodiments of the invention;

FIG. 6E depicts the connector of FIG. 6A at a detached state, in accordance with some demonstrative embodiments of the invention;

DETAILED DESCRIPTION

Figure 1A:
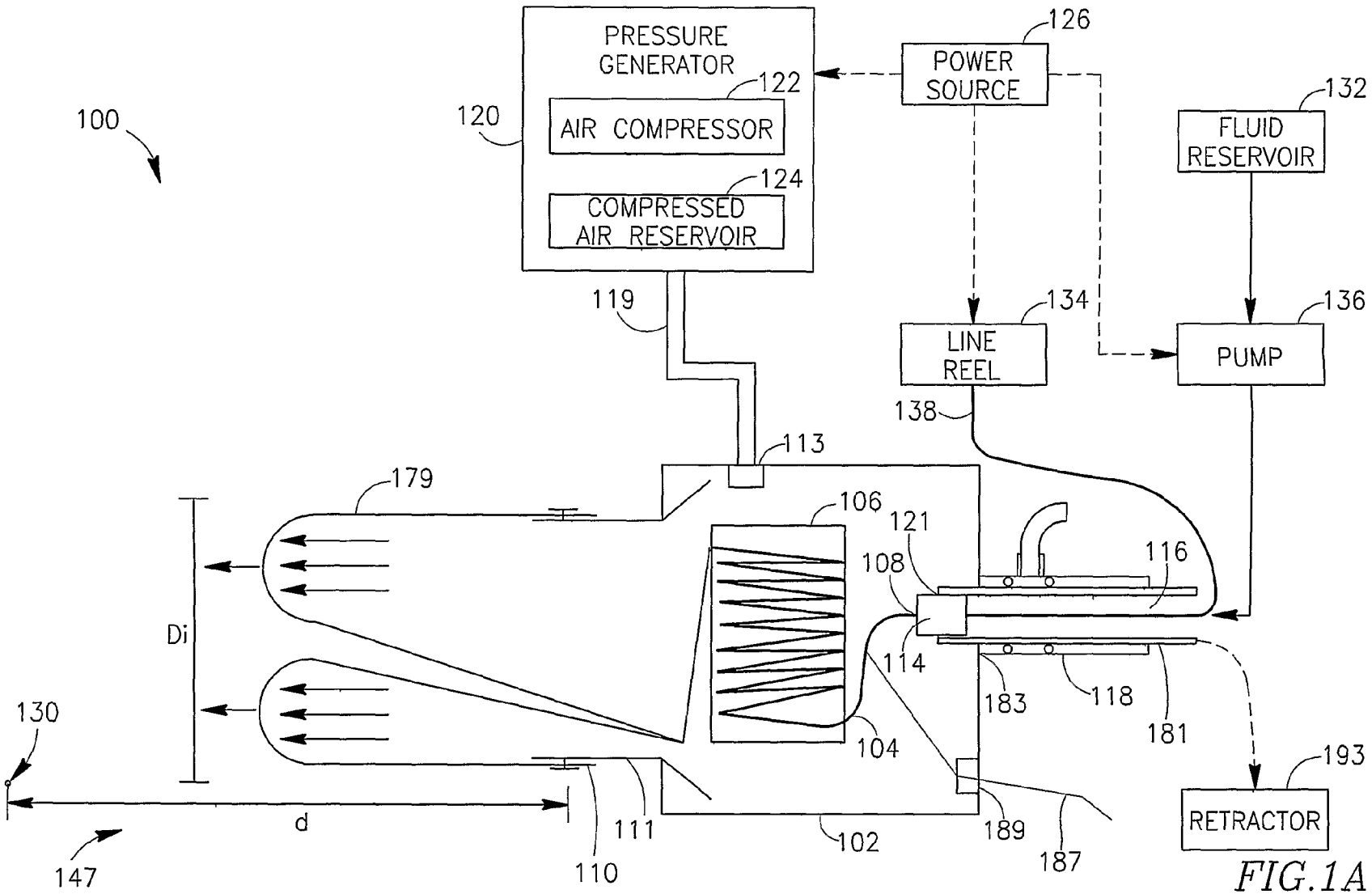
FIG. 1A is a schematic illustration of a deployment system, in accordance with some demonstrative embodiments of the present invention.

In the following detailed description, numerous specific details are set forth in order to provide a thorough understanding of some embodiments of the invention. However, it will be understood by persons of ordinary skill in the art that embodiments of the invention may be practiced without these specific details. In other instances, well-known methods, procedures, components, units and/or circuits have not been described in detail so as not to obscure the discussion.

Unless specifically stated otherwise, as apparent from the following discussions, it is appreciated that throughout the specification discussions utilizing terms such as "processing," "computing," "calculating," "determining", or the like, refer to the action and/or processes of a computer or computing system, or similar electronic computing device, that manipulate and/or transform data represented as physical, such as electronic, quantities within the computing system's registers and/or memories into other data similarly represented as physical quantities within the computing system's memories, registers or other such information storage, transmission or display devices.

The term "plurality" may be used throughout the specification to describe two or more components, devices, elements, parameters and the like.

It should be understood that some embodiments of the invention may be used in a variety of applications. Although embodiments of the invention are not limited in this respect, one or more of the methods, devices and/or systems disclosed herein may be used in many applications, e.g., civil applications, military applications, or any other suitable application.

In one example, a deploying system as described herein may be implemented to deploy a fluid payload, for example, a fluid explosive, e.g., an emulsion explosive, as described in detail below.

In another example the deploying system may be implemented to deploy over a deployment line, any suitable unit or device, for example, a monitoring and/or surveillance transducer, e.g., a camera and/or a microphone, and/or a detector, e.g., a gas detector and/or an explosive detector, and/or in any other suitable payload.

According to some demonstrative embodiments of the invention, a deployment system may include an invertible sleeve capable of being expanded from an unexpanded state to an expanded state in an inside-out manner, wherein at least part of first and second surfaces of the sleeve, which face outward and inward, respectively, when the sleeve is at the unexpanded state, face inward and outward, respectively, when the sleeve is in the expanded state, as described below.

Although embodiments of the invention are not limited in this respect, the term "expanded state" as used herein with respect to a sleeve may refer to any state other than the unexpanded state of the sleeve, e.g., wherein the sleeve is partially or entirely expanded.

According to some demonstrative embodiments of the invention, the deployment system may also include a payload conveyer to convey and/or carry the payload. The payload conveyer may be detachably connectable to a first end of the sleeve, e.g., as described in detail below.

According to some demonstrative embodiments of the invention, the deployment system may also include a pressurizer to expand the sleeve to the expanded state, for example, by applying a pressure to a second end of the sleeve, e.g., as described in detail below.

According to some demonstrative embodiments of the invention, the sleeve may be positioned within the pressurizer, e.g., within a cartridge. The second end of the sleeve may be connected, e.g., securely, to an outlet of the pressurizer, e.g., as described in detail below.

According to some demonstrative embodiments of the invention, the sleeve may be expanded from the unexpanded state, e.g., to the expanded state, for example, by introducing a pressurized substance, e.g., compressed air, into the sleeve, as described in detail below.

Accordingly, the first end of the sleeve may reach a location, which may be at a distance smaller than or equal to a length of the sleeve. The payload conveyer, which may be connected to the first end of the sleeve, may travel together with the first end of the sleeve to the reached location. The payload conveyer may be detached from the sleeve, e.g., after expanding the sleeve.

According to some demonstrative embodiments of the invention, the deployment system may also include a detachable connector to be connected to the first end of the sleeve, and to the payload conveyer.

According to some demonstrative embodiments of the invention, the payload conveyer may include a hose, which may be detachably connected to the connector, e.g., as described in detail below.

According to some demonstrative embodiments of the invention, the hose may convey the payload, e.g., through the sleeve. The hose may have at least the length of the sleeve, e.g., as described in detail below.

According to some demonstrative embodiments of the invention, the first end of the sleeve may be detached from the hose, for example, by detaching the connector from the hose, e.g., after the sleeve has reached the location. The connector may be detached from the hose, for example, by applying a pressure to the connector via the hose, e.g., as described below.

According to some demonstrative embodiments of the invention, the payload may be deployed through the hose at one or more locations along a path of the expanded sleeve ("the deployment path"), e.g., as described in detail below.

According to some demonstrative embodiments of the invention, the payload may include a fluid substance, for example, a fluid explosive, e.g., an emulsion explosive, as described below.

According to some demonstrative embodiments, at least part of the payload may be deployed within the sleeve, such that the sleeve may contain and/or confine the payload, e.g., as described below.

According to other demonstrative embodiments of the invention, at least part of the payload may be deployed externally to the sleeve, for example, if the sleeve is retracted after detaching the payload conveyer from the sleeve, and before and/or during deploying the payload, e.g., as described below.

According to some demonstrative embodiments of the invention, the payload conveyer may include a deployment line. The deployment line may be attached, for example, to the detachable connector. The connector may be detachably connected to the sleeve. For example, the connector may be detached from the sleeve, e.g., after the sleeve has reached the location.

According to some demonstrative embodiments of the invention, the connector may include an attachment mechanism to attach the connector to an object at the target location. The payload may be deployed over the deployment line at a suitable location along the deployment line.

Reference is now made to FIG. 1A, which schematically illustrates a deployment system 100, in accordance with some demonstrative embodiments of the invention.

According to some demonstrative embodiments, system 100 may include an invertible sleeve 104 to be expanded in an inside-out manner along a deployment path 147 into an expanded state, in which a first end 108 of sleeve 104 may reach a location 130 at a distance d. A length of sleeve 104 at the expanded state may be equal to or longer than the distance d.

According to some demonstrative embodiments of the invention, system 100 may also include a pressurizer 102 to contain sleeve 104 at an unexpanded state. For example, system 100 may include a cartridge 106 to hold sleeve 104 within pressurizer 102. Pressurizer 102 may have an outlet 111 to be connected, e.g., tightly, to a second end 110 of sleeve 104, e.g., as described below.

According to some demonstrative embodiments, pressurizer 102 may be capable of expanding sleeve 104 to the expanded state, for example, by applying a pressure to sleeve 104, e.g., through end 110, as described in detail below.

According to some demonstrative embodiments of the invention, system 100 may also include a pressure generator 120 to provide pressure to pressurizer 102, e.g., via a pressure inlet 113 of pressurizer 102. In one example, pressure generator may provide pressurizer 102 with a pressurized gas, e.g., pressurized air. For example, pressure generator 120 may include an air compressor 122 to compress air within a pressure reservoir 124 at a predefined pressure, denoted p. The compressed air of pressure reservoir 124 may be provided to pressurizer 102, e.g., via a pipe 119 connected to inlet 113. The pressurized air may fill sleeve 104 through outlet 111, thereby expanding sleeve 104.

According to some demonstrative embodiments of the invention, the length of sleeve 104 maybe predetermined, for example, based on a measurement of the distance d, and/or an evaluation of the distance d. For example, if the payload includes a fluid explosive to be deployed within a tunnel, e.g., as described below, then a length of sleeve 104 may be selected based on a measured or evaluated length of the tunnel.

According to some demonstrative embodiments of the invention, sleeve 104 may have a length of at least 25 meters (m), for example, 25 m, 45 m, 60 m, 90 m, or any other suitable length.

According to some demonstrative embodiments, one or more geometrical and/or structural properties of invertible sleeve 104 may be based, for example, on one or more mechanical loads and/or forces, which are to be applied to sleeve 104 including, for example, the pressure p, a tension exerted upon sleeve 104 during the expansion of sleeve 104, and/or external forces, which may be applied to sleeve 104 by an environment in which sleeve 104 is to be expanded, e.g., friction with one or more walls of a tunnel, obstacles and the like.

According to some demonstrative embodiments, a surface 179 of sleeve 104 may face inwardly when sleeve is at the unexpanded state and outwardly when sleeve 104 is in the expanded state. Surface 179 may have a friction factor value smaller than 0.25, for example, smaller than 0.23, e.g., smaller than 0.21. For example, surface 179 may be lubricated by any suitable lubricant, e.g., including Polywater Plus Silicone™ or Polywater Prelube 2000™ available from American Polywater Corporation, Minnesota, USA, paraffin oil, Silicone grease, and the like; and/or surface 179 may be formed of a suitable material to achieve the desired friction factor value.

According to some demonstrative embodiments of the invention, sleeve 104 may be formed of any suitable material. In some embodiments, sleeve 104 may have tension strength of at least 70 kilograms (kg), for example, at least 100 kg, e.g., at least 150 kg. In one example, sleeve 104 may include a membrane formed of a polymer-coated fabric, such as a polymer of vinyl chloride (PVC) coated glass fiber fabric, e.g., the "Eitanit 6100" material available from Erez Thermoplastic Products, Israel.

According to some demonstrative embodiments of the invention, system 100 may be implemented to deploy a payload at one or more locations along path 147.

According to some demonstrative embodiments, system 100 may include a payload conveyer to convey and/or carry the payload. The payload conveyer may be detachably connected to end 108. For example, system 100 may include a detachable connector 114 to detachably connect the payload conveyer to end 108, e.g., as described in detail below.

According to some demonstrative embodiments, the payload may include a fluid substance, for example, a fluid explosive, e.g., an emulsion explosive as described below.

According to some demonstrative embodiments, the payload conveyer may include a hose 116, which may be inserted into pressurizer 102 via an inlet 183, and detachably connected to end 108, for example, by detachable connector 114. For example, connector 114 may be connected to end 108 and to an end 121 of hose 116, e.g., as described in detail below. System 100 may include, for example, a fluid reservoir 132 to accommodate the fluid substance; and a pump 136 to pump the fluid substance through hose 116, for example, after connector 114 has been detached from hose 116, e.g., as described below with reference to FIG. 2.

According to some demonstrative embodiments, a length of hose 116 may be equal to or longer than the distance d. In one example, the length of hose 116 may be at least equal to the length of sleeve 104.

According to some demonstrative embodiments, detachable connector 114 may enable detaching hose 116 from sleeve 104, such that hose 116 may move independently from sleeve 104, for example, after hose 116 reaches location 130. Connector 114 may be connected to hose 116 and end 108, e.g., prior to expanding sleeve 104; and detached from at least one of hose 116 and end 108, e.g., after sleeve 104 is expanded. In one example, detachable connector 114 may be detached from hose 116, by applying a pressure to connector 114 via hose 116. In one example, compressed air, e.g., from pressure generator 120, may be provided through hose 116 to detach connector 121. In other examples, any other pressurized substance may be implemented to detach connector 114. For example, pressurized water may be pumped through hose 116, e.g., in order to exert a relatively high force on connector 114.

In one demonstrative embodiment of the invention, connector 114 may be detachably connected to end 108 such that, for example, upon detachment of connector 114 from hose 116, an opening is formed at end 108 of sleeve 104, allowing deployment of a payload externally to sleeve 104, e.g., as described below with reference to FIGS. 3A and 3B.

In another demonstrative embodiment of the invention, connector 114 may be securely connected to end 108 such that, for example, upon detachment of connector 114 from hose 116, end 108 of sleeve 104 may be sealed, e.g. by connector 114. Accordingly, deployment of the payload may be performed internally to sleeve 104, as described below with reference to FIGS. 3A and 3B.

According to some demonstrative embodiments of the invention, system 100 may also include a lubricator 118 to apply a lubricant to at least part of an outer surface 181 of hose 116. For example, lubricator 118 may apply the lubricant to a portion of surface 181, which enters pressurizer 102 in order, for example, to reduce a friction between surface 181 and a surface of sleeve 104 in contact with surface 181, and/or between surface 181 and an inner surface of inlet 183. Lubricator 118 may include any suitable lubrication device and/or mechanism. In one example, lubricator 118 may include a liquid seal mechanism to form an annulus between surface 181 and the inner surface of inlet 183. Lubricator 118 may force lubricant through small holes in inlet 183 to fill the annulus, such that surface 181 may move through the lubricant, while being coated by a thin and controllable layer of the lubricant due to the boundary layer effect. The lubricant may include, for example, the Polywater Plus Silicone™ or Polywater Prelube 2000™, paraffin oil, Silicone grease, or any other suitable lubricant.

According to some demonstrative embodiments, system 100 may also include a hose retractor 193 to retract hose 116 at a retraction rate, denoted $\upsilon$. Retractor 193 may include any suitable device, system, configuration or mechanism, e.g., including a reel and an engine, able to retract hose 116 at the rate $\upsilon$.

According to some embodiments, the payload may include at least one suitable device or system to be deployed at one or more locations along path 147. For example, the payload may include a monitoring and/or surveying transducer, e.g., a camera, a microphone, a gas detector, an explosive detector, and the like.

According to some demonstrative embodiments of the invention, the payload conveyer may include a deployment line 138 to convey the payload. Deployment line 138 may include any suitable wire, cable, string, rope, cord, and the like. According to these embodiments, system 100 may also include, for example, a suitable cable reel 134 to hold deployment line 138.

According to some demonstrative embodiments of the invention, deployment line 138 may be detachably connected to sleeve 104. For example, detachable connector 114 may be connected to deployment line 138 and to end 108, e.g., as described below with reference to FIG. 4. For example, connector 114 may be adapted to be connected, e.g., tightly, to an end of line 138, and detachably connected to end 108. Connector 114 may be connected, for example, to end 108 and an end of line 138, e.g., prior to expanding sleeve 104; and detached from end 108, e.g., after sleeve 104 reaches location 130. In one example, line 138 may be connected to connector 114 through hose 116. However, embodiments of the invention are not limited in this respect, and in another example line 138 may be fed into pressurizer 102 through any suitable line inlet (not shown), e.g., if hose 116 is not implemented.

According to some demonstrative embodiments, detachable connector 114 may optionally include any suitable device and/or mechanism to perform one or more predefined operations at location 130 and/or along path 147, e.g., as described below.

In some demonstrative embodiments, connector 114 may include an attachment mechanism, e.g., to attach and/or anchor connector 114 to an object at location 130. In one example, the attachment mechanism may attach connector 114 to the object, such that the payload may be transported to one or more locations along path 147 over line 138, e.g., as described below with reference to FIG. 4. In one example, the attachment mechanism may be forced to attach to the object by the pressure applied to detach connector 114 from hose 116.

According to some embodiments, detachable connector 114 may include any suitable detonatable bullet (not shown), which may be detonated locally, e.g., upon the detachment of connector 114 at location 130. In one example, connector 114 may include a reactive gas container (not shown), for example, a tear gas or anesthetic gas, to be released at location 130, e.g., after the detonatable bullet penetrates a wall, a door or any other obstacle, without the need for close human presence in a danger area.

According to some demonstrative embodiments of the invention, system 100 may also include a suitable power source 126 to provide electrical and/or mechanical power to air compressor 122, pump 136 and/or cable reel 134.

Figure 1B:
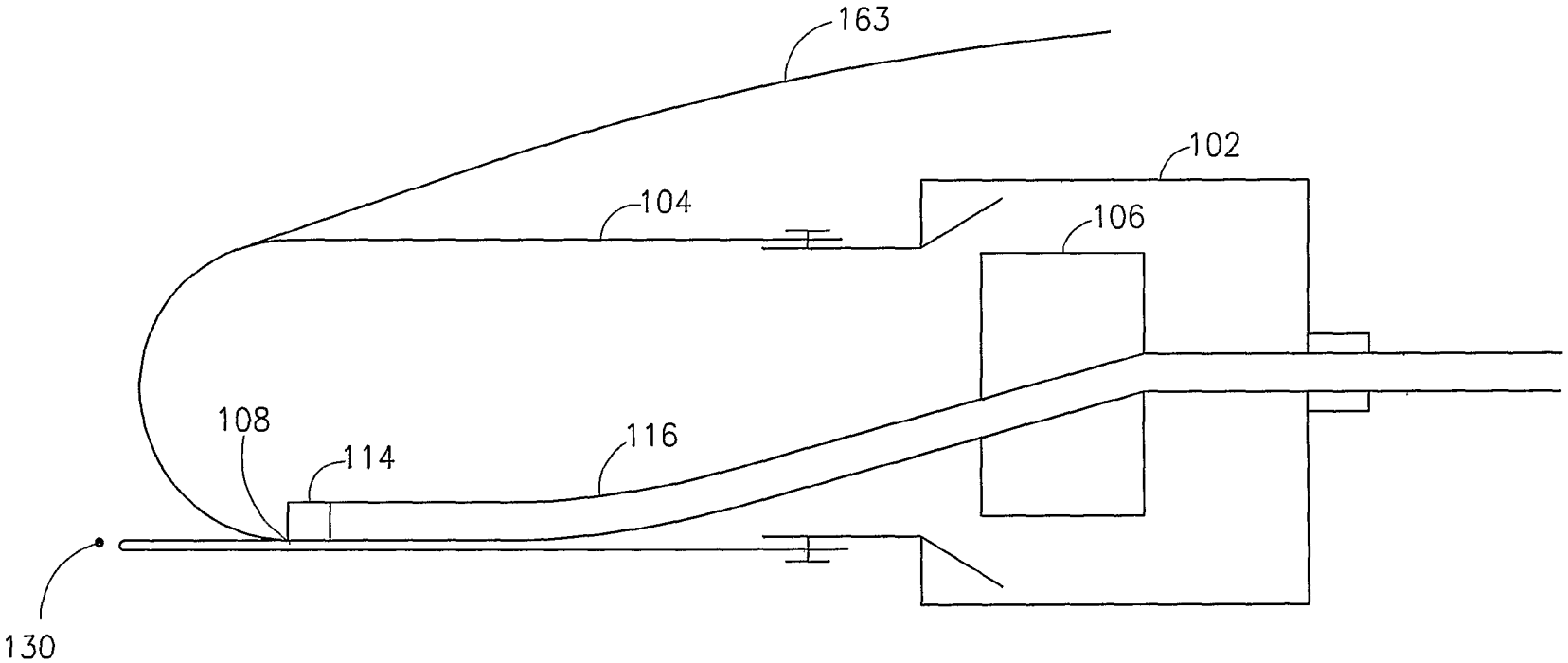
FIG. 1B is a schematic illustration of an invertible sleeve of the system of FIG. 1A at an expanded state, in accordance with some demonstrative embodiments of the invention.

Reference is also made to FIG. 1B, which schematically illustrates sleeve 104 at the expanded state, in accordance with some demonstrative embodiments of the invention. As shown in FIG. 1B, both end 108 of sleeve 104 and end 121 of hose 116, which may be connected to end 108 by connector 114, may be in proximity to location 130, when sleeve 104 is at the expanded state. Hose 116 may be detached from sleeve 104, for example, by applying a pressure from within hose 106 to connector 114, as described below. Accordingly hose 116 may move independently from sleeve 104, e.g., to allow deployment of the fluid substance at one or more locations along path 147, as described below with reference to FIG. 2.

According to some demonstrative embodiments of the invention, system 100 may be used in a variety of applications, e.g., military and/or civil applications, to deploy any suitable payload in any suitable form at any suitable location, e.g., as described below.

According to some demonstrative embodiments of the invention, system 100 may be implemented to deploy the payload within any suitable environment, location, area, domain, region, terrain, and/or topography.

In some embodiments, system may 100 may be implemented for subterranean deployment, for example, at one or more unreachable locations. For example, system 100 may be implemented to deploy the payload within a subterranean tunnel of known or unknown length and/or structure, and/or having substantially intricate and/or sharp curves. In such a case, sleeve 104 may be, for example, self-guided through interaction with the tunnel walls.

In other embodiments, system may be implemented for aboveground deployment. When expanded aboveground, sleeve 104 may be guided by any suitable guidance system and/or mechanism, for example, one or more guidance and/or retraction lines 163 which may be attached to sleeve 104, e.g., to end 108. In one example, guidance lines may be used to retract sleeve 104. In another example, lines 163 may be implemented to guide sleeve 104 to follow a desired expansion path.

In one example, system 100 may be implemented as part of a process of opening a passageway in a minefield. For example, sleeve 104 may be expanded, e.g., aboveground, along path 147 corresponding to a desired passageway within the minefield; and a fluid explosive may be deployed along path 147, e.g., internally or externally to sleeve 104. The fluid explosive may then be detonated.

In another example, system 100 may be implemented to convey a fluid substance, for example, a reactive fluid, e.g., a fluid explosive; and/or any other payload, for example, a surveillance device or system, to a floor of a building.

In another example, system 100 may be implemented to deploy a payload at a level higher than a level of pressurizer 102 ("the feeding zone"), for example, by expanding sleeve 104 in a generally upward direction, e.g., using suitable guiding cables (not shown). In one example, a collar-like piston (not shown) may be attached to an end of hose 116 through which a fluid explosive may be provided, to prevent the fluid explosive from flowing in a downward direction. The piston may be secured, e.g., upon reaching a bottom end of sleeve 104, and hose 116 may be retracted while vertically filling sleeve with the fluid explosive, which may be detonated.

In another example, system 100 may be implemented to anchor cables, for example, to a hard reachable and/or high place.

In another example, system 100 may be implemented to deploy anchoring cables across a passage barrier, e.g., a trench. For example, sleeve 104 may be expanded, e.g., aboveground, along path 147 through and/or over the passage barrier; and the anchoring cables may be deployed along path 147.

According to other demonstrative embodiments of the invention, system 100 may be implemented to deploy any suitable fluid substance, e.g., a fluid explosive, having any suitable viscosity, for example, a relatively high viscosity, for example, a viscosity of at least 15,000 centipoises (cP), e.g., at least 30,000 cP. The fluid substance may be deployed at one or more desired locations along path 147 in a continuous and/or discontinuous manner, e.g., as described below. At least some of the fluid substance may be deployed within sleeve 104, and/or at least some of the fluid substance may be deployed externally to sleeve 104, e.g., as described below with reference to FIGS. 3A and 3B.

According to some demonstrative embodiments, one or more geometrical and/or structural properties of sleeve 104 may be based, for example, on one or more properties of the fluid explosive, e.g., as described below.

According to some demonstrative embodiments, the fluid explosive may include an emulsion explosive. The emulsion explosive may be generated, for example, by mixing an emulsion explosive matrix with one or more additives, for example, a sensitizer, e.g., as known in the art. In one example, the matrix may be mixed with a first additive and a second additive, e.g., at a relation of 98%, 0.5% and 1.5%, respectively. The resulting emulsion explosive may have, for example, a density of approximately 1.05 grams per cubic centimeter ($g/cm^3$). The matrix may include, for example, an oil-in-water emulsion of ammonium nitrate, water, fuel oil and emulsifier, which may be available from Explosives Manufacturing Industries (1977) LTD, Zichron Jacob, Israel. The first additive may include, for example, a solution formed of approximately 70% water, 20% Sodium Nitrite ($NaNO_2$), and 10% Sodium thiocyanate (NaSCN). The second additive may include, for example, a solution formed of approximately 60% acetic acid ($CH_2COOH$), and 40% water.

According to some demonstrative embodiments of the invention, a critical diameter of the emulsion explosive may relate to a minimal diameter at which the explosive may be detonated. At a diameter lower than the critical diameter the emulsion explosive may undergo deflagration. The critical diameter of the emulsion explosive may be related to a density of the emulsion explosive, e.g., as follows:

TABLE 1

| Density (g/cm$^3$) | Critical Diameter (inches) |
|---|---|
| 1.3 | 6 |
| 1.28 | 6 |
| 1.27 | 4 |
| 1.25 | 4 |
| 1.15 | 2 |
| 1 | 1 |

According to some demonstrative embodiments of the invention, a diameter Di, of sleeve 104 may be related, for example, to the critical diameter of the emulsion explosive, in order to allow, for example, detonation of the emulsion explosive within sleeve 104. For example, the diameter Di may be bigger than the critical diameter of the emulsion explosive, which may be determined based on the density of the emulsion explosive, e.g., in accordance with Table 1. In one example, sleeve 104 may have a diameter of approximately 8 inches.

According to some demonstrative embodiments of the invention, pressurizer 102 may include a detonation wire inlet 189 to allow insertion of a detonation wire 187 into pressurizer 102. Detonation wire 187 may include any suitable detonation wire to detonate the fluid explosive. Detonation wire may be connected, e.g., tightly, in proximity to end 108 of sleeve 104. Accordingly, as sleeve 104 is expanded, detonation wire 187 may be advanced together with sleeve 104 along the deployment path towards location 130.

According to some demonstrative embodiments of the invention, one or more of pressure generator 120, power source 126, pump 136, and/or reservoir 132 may be implemented by one or more elements of any conventional deployment system, e.g., a conventional fluid explosive deployment system. In one example, air compressor 122, compressed air reservoir 124, power source 126, fluid reservoir 132, and/or pump 136 may be implemented by the MP1000 emulsion explosive generator available from TREAD Corporation of Roanoke, Va., USA, e.g., as described below with reference to FIGS. 9A and 9B. According to this example, hose 116 may include a hose operable with the MP1000 emulsion explosive generator.

According to some demonstrative embodiments of the invention, system 100 may include a transportable deployment system. For example, one or more elements of system 100 may be installed on a vehicle. In one example, pressurizer 102, pressure generator 120, pump 136 and/or reservoir 132 may be installed on a trailer towed by a vehicle, for example, a truck, e.g., as described below with reference to FIGS. 9A and 9B.

Figure 2:
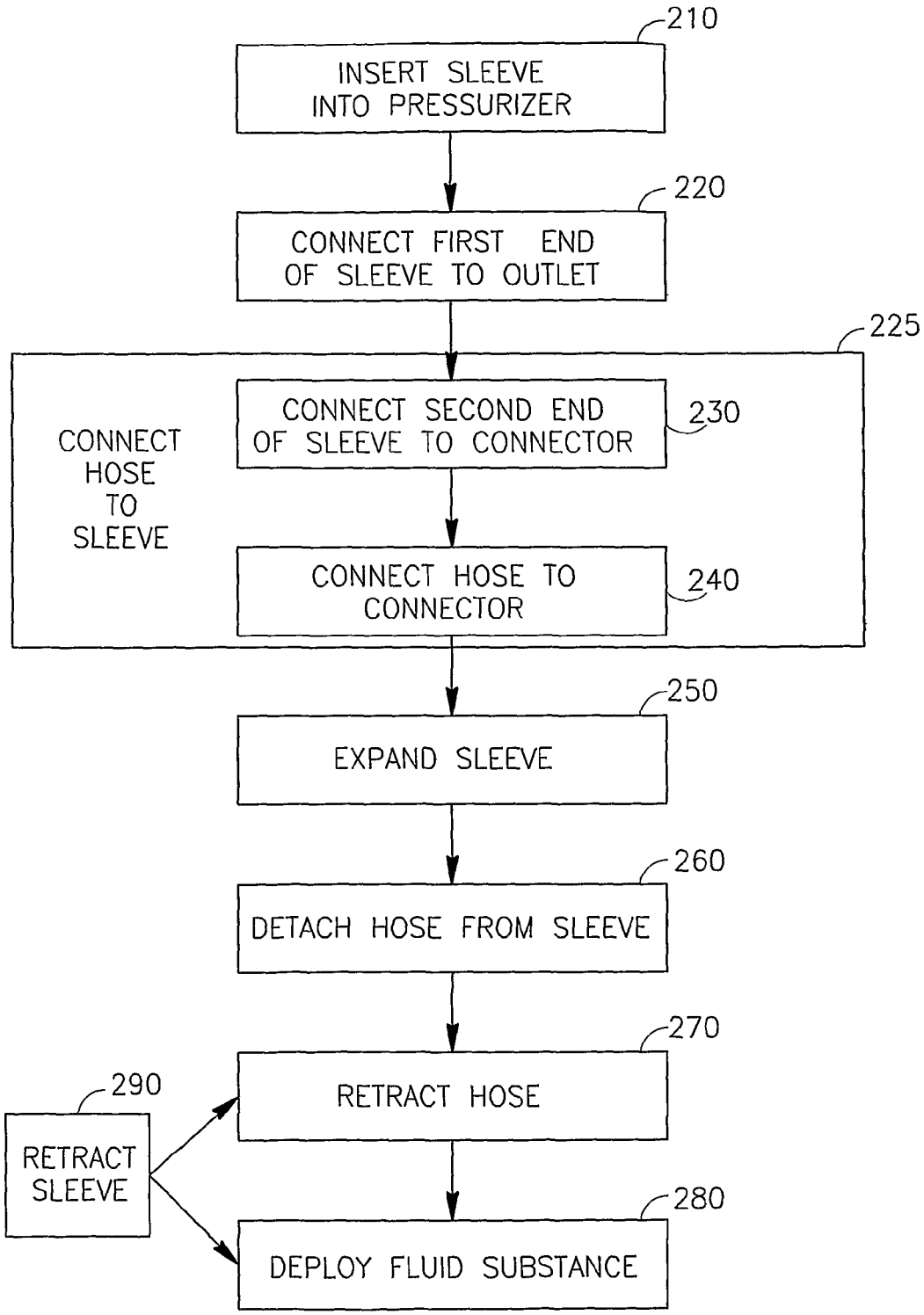
FIG. 2 is a schematic flow-chart illustration of a method of deploying a fluid substance, in accordance with some demonstrative embodiments of the invention.

Reference is now made to FIG. 2, which schematically illustrates a method of deploying a fluid substance, in accordance with some demonstrative embodiments of the invention. Although embodiments of the invention are not limited in this respect, according to some embodiments one or more operations of the method of FIG. 2 may be performed by one or more elements of system 100 (FIG. 1A) to deploy the fluid substance, for example, a fluid explosive, e.g., an emulsion explosive.

As indicated at block 210, the method may include inserting an invertible sleeve into a pressurizer. For example, sleeve 104 (FIG. 1A) may be inserted into cartridge 106 (FIG. 1A), which may be installed within pressurizer 102 (FIG. 1A).

As indicated at block 220, the method may also include connecting an end of the sleeve to an outlet of the pressurizer, e.g., tightly. For example, end 110 (FIG. 1A) of sleeve 104 (FIG. 1A) may be tightly connected to outlet 111 (FIG. 1A) of pressurizer 102 (FIG. 1A).

As indicated at block 225, the method may also include connecting another end of the sleeve to a payload conveyer, e.g., a hose, as described below.

As indicated at block 230, connecting the hose to the sleeve may include connecting the other end of the sleeve to a connector. For example, end 108 (FIG. 1A) of sleeve 104 (FIG. 1A) may be connected to connector 114 (FIG. 1A).

As indicated at block 240, connecting the hose to the sleeve may include connecting the hose to the connector. For example, end 121 (FIG. 1A) of hose 116 (FIG. 1A) may be connected to connector 114 (FIG. 1A).

As indicated at block 250, the method my include expanding the sleeve, for example, by applying a pressure, e.g., via the pressurizer. For example, compressed air from reservoir 124 (FIG. 1A) may be provided to pressurizer 102 (FIG. 1A) and to sleeve 104 (FIG. 1A) via outlet 111 (FIG. 1A). In one example, the pressurizer may be pressurized to a pressure of between 1 atmosphere (atm) and 5 atm, for example, between 2 atm to 3 atm, e.g., between 1 atm to 2 atm.

As indicated at block 260, the method may include detaching the payload conveyer from the sleeve. In one example, detaching the payload conveyer from the sleeve may include detaching the connector from the hose, for example, by applying pressure to the hose. For example, compressed air may be provided through hose 116 (FIG. 1A), e.g., from pressure generator 120 (FIG. 1A), to detach connector 121 (FIG. 1A). In some embodiments, detaching the payload conveyer from the sleeve may also include detaching the connector from the sleeve to form an opening in the sleeve, e.g., as described above.

As indicated at block 270, the method may include retracting the hose. For example, retractor 193 (FIG. 1A) may retract hose 116 (FIG. 1A) at the retraction rate ν. In one example, the retraction rate ν may be approximately 7.5 m per minute.

As indicated at block 280, the method may also include deploying the fluid substance through the hose. For example, pump 136 (FIG. 1A) may pump fluid substance from fluid reservoir 132 (FIG. 1A) into hose 116 (FIG. 1A). The fluid substance may include, for example, a fluid explosive, e.g., the emulsion explosive described above.

According to some demonstrative embodiments, deploying the fluid substance may include deploying at least part of the fluid substance within the expanded sleeve such that, for example, the sleeve may contain and/or confine the fluid substance.

According to some demonstrative embodiments of the invention, deploying the fluid substance may include deploying at least part of the fluid substance externally to the expanded sleeve. For example, as indicated at block 290 the method may include at least partially retracting the sleeve, e.g., after the hose is detached from the sleeve. In one example, the sleeve may be retracted substantially entirely in order, for example, to deploy the fluid substance externally to the sleeve along the entire deployment path. In another example, the sleeve may be partially retracted in order, for example, to deploy the fluid substance externally to the sleeve along a first section of the path, and internally to the sleeve along a second section of the deployment path.

According to some demonstrative embodiments, deploying the fluid substance may include deploying the fluid substance substantially continuously, e.g., along substantially the entire deployment path; or intermittently, e.g., along one or more sections of the deployment path.

Figure 3A:
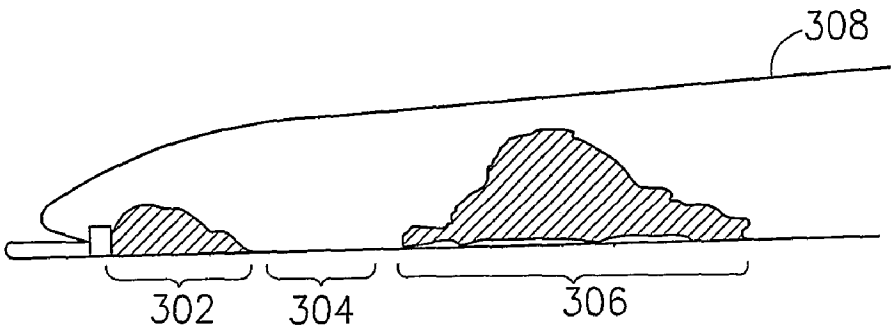
FIG. 3A is a schematic illustration of a first fluid deployment scheme, in accordance with one demonstrative embodiment of the invention.

FIG. 3A schematically illustrates a first fluid deployment scheme, in accordance with one demonstrative embodiment of the invention. As shown in FIG. 3A, the fluid substance may be intermittently deployed within a sleeve 308 along a first section 302 and a second section 304, which are separated by a third section 304. For example, pump 136 (FIG. 1A) may pump the fluid substance from fluid reservoir 132 (FIG. 1A) into hose 116 (FIG. 1A) during first and second time periods, while hose 116 (FIG. 1A) is retracted along sections 302 and 306, respectively. The fluid substance may not be pumped into the hose, for example, during a third time period between the first and second time periods, while the hose is retracted along section 304.

Figure 3B:
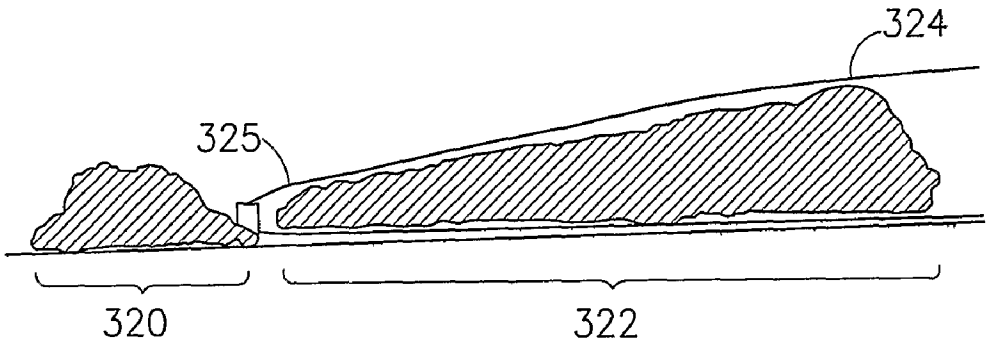
FIG. 3B is a schematic illustration of a second fluid deployment scheme, in accordance with another demonstrative embodiment of the invention.

FIG. 3B schematically illustrates a second deployment scheme, in accordance with another demonstrative embodiment of the invention. As shown in FIG. 3B, the fluid substance may be deployed along a first section 320, externally to a sleeve 324; and along a second section 322, within sleeve 324. For example, connector 114 (FIG. 1) may be detached from hose 116 (FIG. 1) to form an opening at end 108 (FIG. 1) of sleeve 104 (FIG. 1), and pump 136 (FIG. 1A) may pump the fluid substance from fluid reservoir 132 (FIG. 1A) into hose 116 (FIG. 1A), e.g., continuously, while hose 116 (FIG. 1A) is retracted along sections 320 and 322.

According to some demonstrative embodiments of the invention, the retraction rate $\upsilon$ and/or a rate, denoted Q, of deploying the fluid substance may be controlled to achieve any suitable deployment pattern of the fluid substance, e.g., internally and/or externally to sleeve 104 (FIG. 1A). For example, the retraction rate $\nu$ and/or the deployment rate Q may be controlled such that the fluid substance substantially fills sleeve 104 (FIG. 1). The rate Q may be controlled, for example, to achieve deployment of the fluid substance at a desired density within sleeve 104, e.g., a density of approximately 20 kg per meter if the fluid substance includes the emulsion explosive described above. In one example, the deployment rate Q may be between 80 kg and 180 kg per minute. For example, the rate Q may be approximately 150 kg per minute, e.g., if the retraction rate $\upsilon$ is approximately 7.5 meters per minute, in order, for example, to deploy the fluid explosive at a density of 20 kg per meter.

Figure 4:
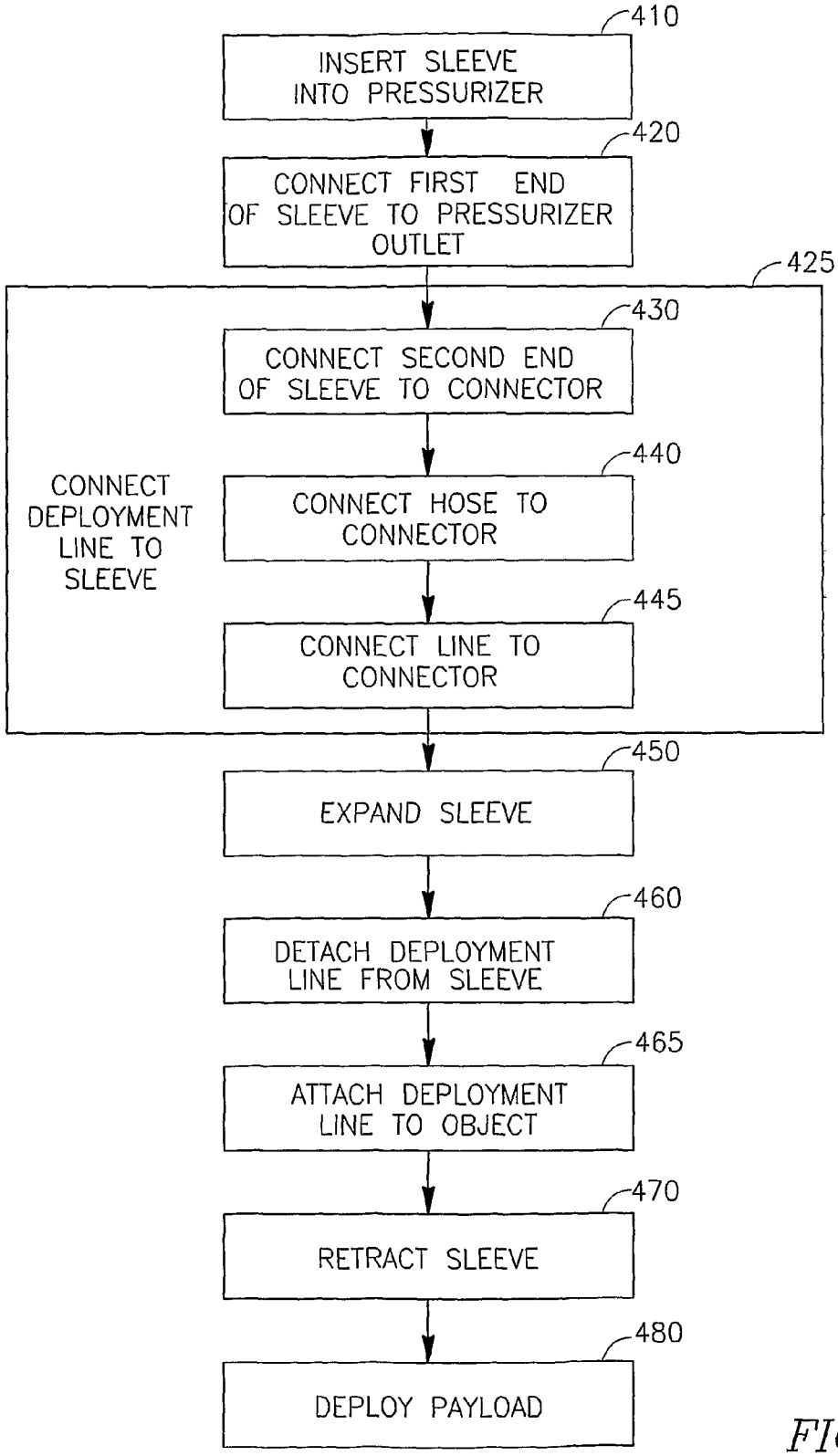
FIG. 4 is a schematic flow-chart illustration of a method of deploying a payload over a deployment line, in accordance with some demonstrative embodiments of the invention.

Reference is now made to FIG. 4, which schematically illustrates a method of deploying a payload over a line, in accordance with some demonstrative embodiments of the invention. Although embodiments of the invention are not limited in this respect, according to some embodiments one or more operations of the method of FIG. 4 may be performed by one or more elements of system 100 (FIG. 1A) to deploy the payload over deployment line 138 (FIG. 1A).

As indicated at block 410, the method may include inserting an invertible sleeve into a pressurizer. For example, sleeve 104 (FIG. 1A) may be inserted into cartridge 106 (FIG. 1A), which may be inserted into pressurizer 102 (FIG. 1A).

As indicated at block 420, the method may also include connecting an end of the sleeve to an outlet of the pressurizer, e.g., tightly. For example, end 110 (FIG. 1A) of sleeve 104 (FIG. 1A) may be tightly connected to outlet 111 (FIG. 1A) of pressurizer 102 (FIG. 1A).

As indicated at block 425, the method may also include connecting another end of the sleeve to a payload conveyer, e.g., a deployment line, as described below.

As indicated at block 430, connecting the sleeve to the deployment line may include connecting the other end of the sleeve to a connector. For example, end 108 (FIG. 1A) of sleeve 104 (FIG. 1A) may be connected to connector 114 (FIG. 1A).

As indicated at block 440, connecting the sleeve to the deployment line may optionally include detachably connecting a hose to the connector, e.g., if the hose is implemented to detach the connector from the sleeve, as described above with reference to FIG. 1A. For example, end 121 (FIG. 1A) of hose 116 (FIG. 1A) may be detachably connected to connector 114 (FIG. 1A).

As indicated at block 445, connecting the sleeve to the deployment line may also include connecting the deployment line to the connector. For example, deployment line 138 (FIG. 1A) may be connected to connector 114 (FIG. 1A), e.g., tightly, as described above.

As indicated at block 450, the method my include expanding the sleeve, for example, by applying a pressure, e.g., via the pressurizer. For example, compressed air from reservoir 124 (FIG. 1A) may be provided to pressurizer 102 (FIG. 1A) and to sleeve 104 (FIG. 1A) via outlet 111 (FIG. 1A).

As indicated at block 460, the method may also include detaching the deployment line from the sleeve. For example, detaching the deployment line from the sleeve may include detaching the connector from sleeve. In one example, the connector may be detached from the sleeve and/or the hose by applying pressure to the hose, e.g., as described above. For example, compressed air from pressure generator 120 (FIG. 1A) may be provided through hose 116 (FIG. 1A) to detach connector 121 (FIG. 1A) from hose 116 (FIG. 1A) and sleeve 104 (FIG. 1A).

As indicated at block 465, the method may include attaching the deployment line to an object. Attaching the deployment line to the object may include, for example, attaching the connector, which may be connected to the deployment line, to the object. For example, an attachment mechanism, e.g., as described herein, may securely attach connector 114 (FIG. 1A) to an object, e.g., a wall, at location 130 (FIG. 1A).

As indicated at block 470, the method may include retracting the sleeve. For example, sleeve 104 (FIG. 1A) may be retracted, e.g., using retraction lines 163 (FIG. 1B), which may be connected to sleeve 104 (FIG. 1B).

As indicated at block 480, the method may also include deploying the payload over the deployment line.

Reference is now made to FIGS. 5A, 5B, 5C, 5D, and 5E, which schematically illustrate an isometric front view, an isometric side view, a front view, a side view, and a back view, respectively, of a pressurizer assembly 500, in accordance with some demonstrative embodiments of the invention. Although embodiments of the invention are not limited in this respect, according to some demonstrative embodiments pressurizer assembly 500 may perform the functionality of pressurizer 102 (FIG. 1A).

According to some demonstrative embodiments, pressurizer assembly 500 may include a door panel 512 secured to a chamber 506, e.g., by a plurality of screws 518. Door panel may be opened to allow inserting, for example, an invertible sleeve into chamber 506.

Figure 5B:
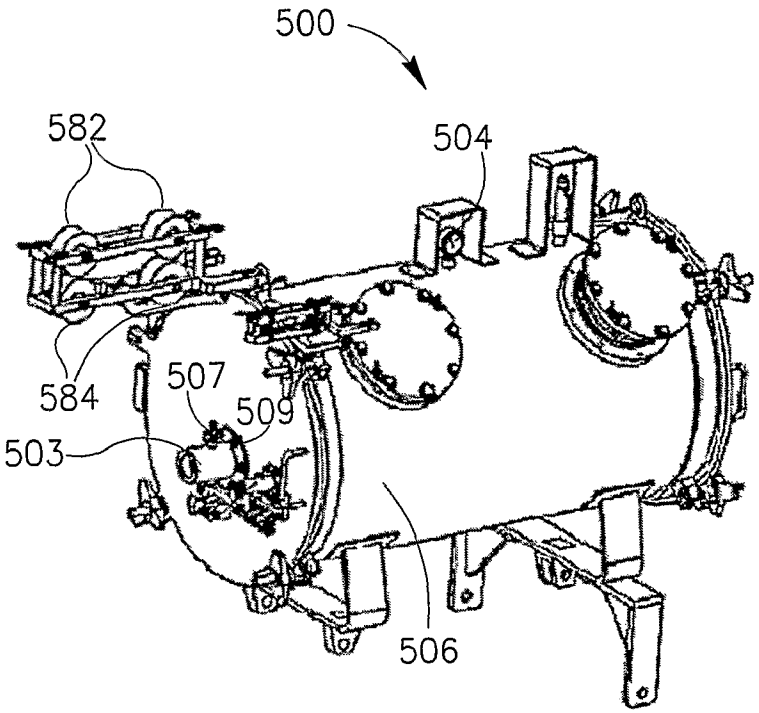
FIGS. 5A, 5B, 5C, 5D, and 5E are schematic illustrations of an isometric front view, an isometric side view, a front view, a side view, and a back view, respectively, of a pressurizer assembly, in accordance with some demonstrative embodiments of the invention.
Figure 5A:
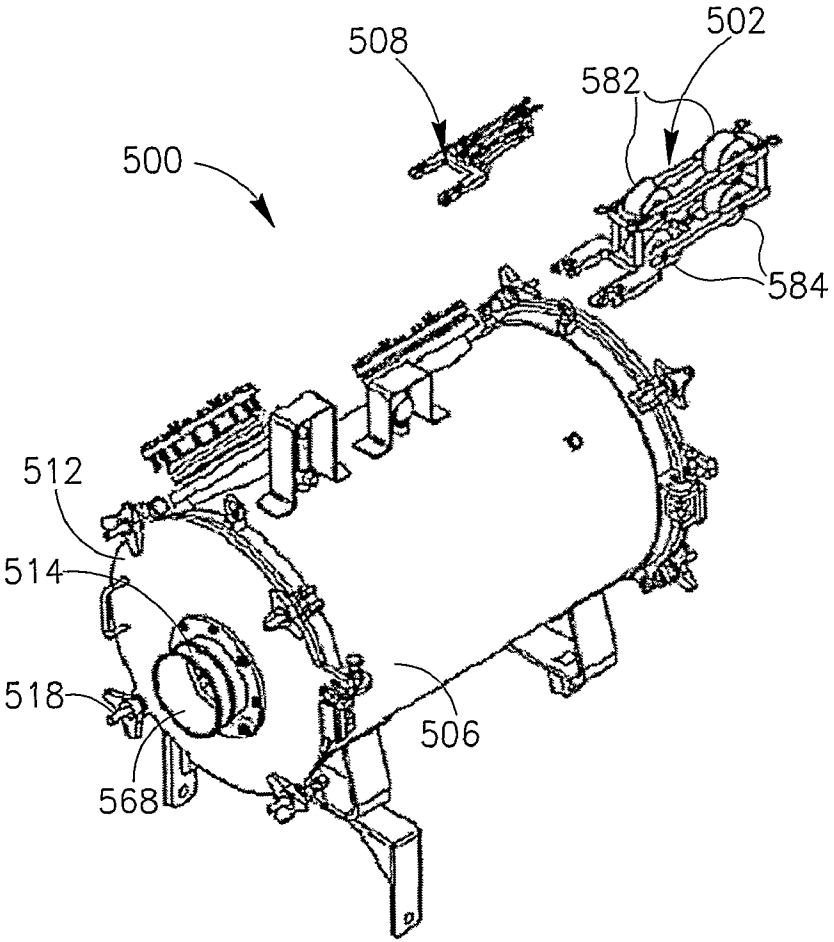
Figure 5E:
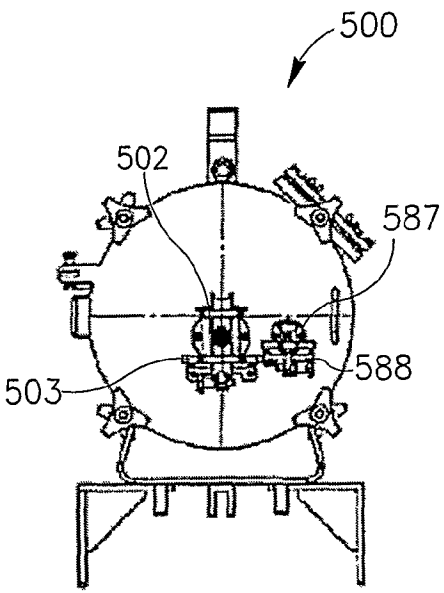
Figure 5D:
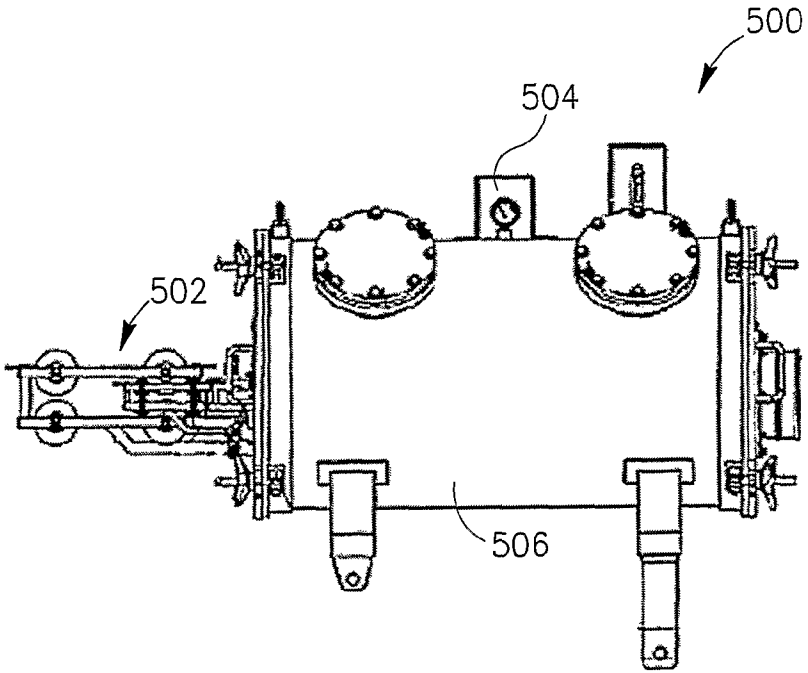
Figure 5C:
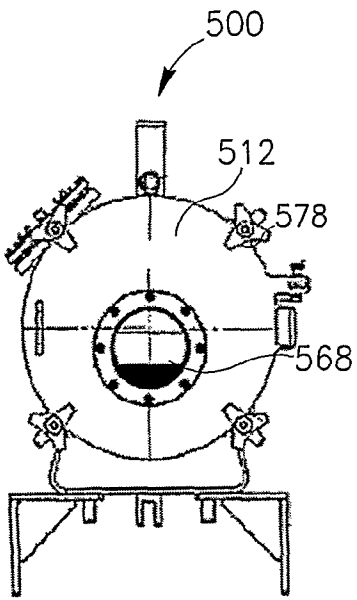
Figure 5F:
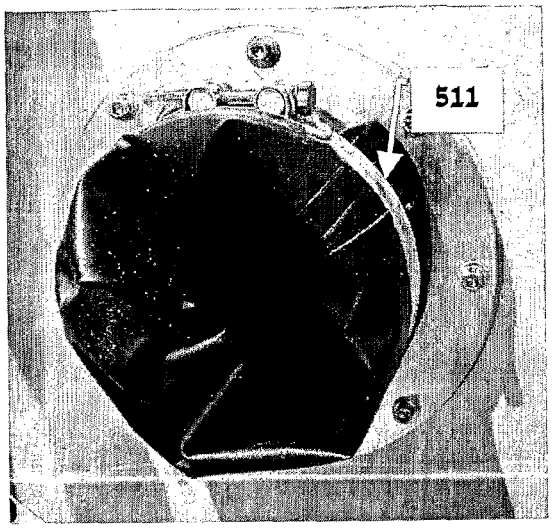
FIG. 5F depicts an installation of a sleeve on the pressurizer assembly of FIGS. 5A-5E, in accordance with some demonstrative embodiments of the invention.

According to some demonstrative embodiments, pressurizer assembly 500 may also include an outlet flange 568 to be connected to an end of the sleeve. For example, after placing the invertible sleeve within chamber 506, the end of the invertible sleeve may be pulled from within chamber 506 through outlet flange 568, and folded over an outer surface 514 of outlet flange 568. As shown in FIG. 5F, a clip 511 may be tightly closed over the end of the sleeve to secure the end of the sleeve to surface 514.

Figure 5G:
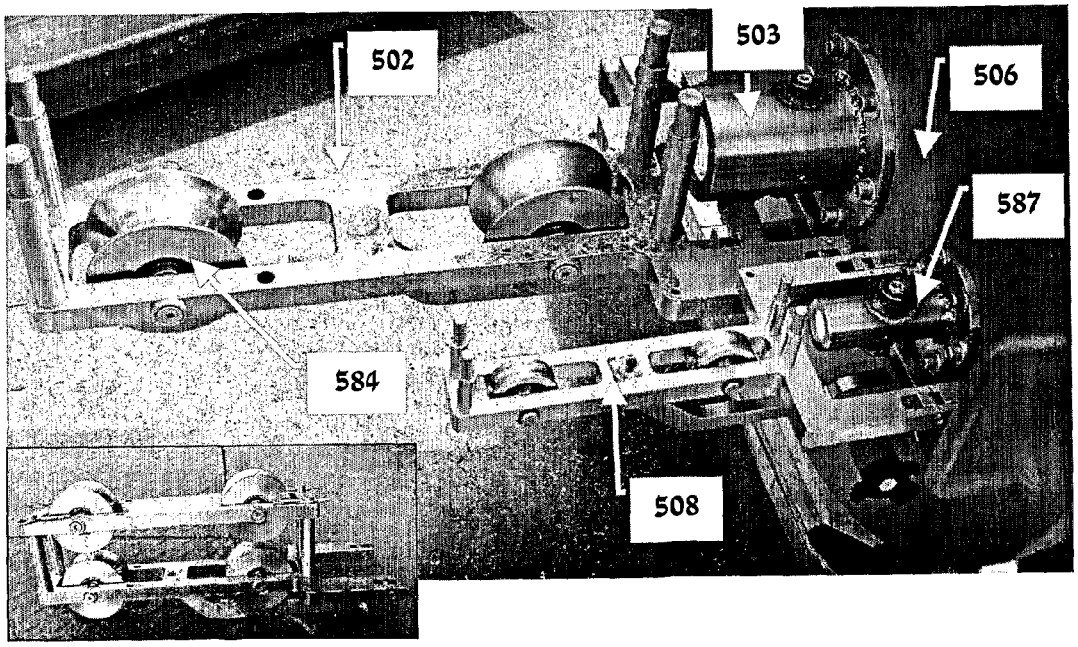
FIG. 5G depicts a hose guiding mechanism and a wire guiding mechanism installed on the pressurizer assembly of FIGS. 5A-5E, in accordance with some demonstrative embodiments of the invention.

According to some demonstrative embodiments of the invention, pressurizer assembly 500 may also include a hose guiding mechanism 502 and a wire guiding mechanism 508. FIG. 5G depicts hose guiding mechanism 502 and wire guiding mechanism 508 during installation on chamber 506. Mechanism 502 may include, for example, a plurality of rollers to guide a hose (not shown in FIG. 5) into chamber 506 via a lubricator 503 connected to a hose inlet 509 of pressurizer 500. For example, the hose may be guided between a set of upper rollers 582 (not shown in FIG. 5G) which may be connected to a set of lower rollers 584. Lubricator 503 may include, for example, a pump connector 507 to be connected to a lubrication pump (not shown) to provide a lubricant to lubricate an outer surface of the hose, e.g., as described above. An end of the hose may be connected to another end of the invertible sleeve, for example, using a detachable connector, e.g., detachable connector 114 as described above with reference to FIG. 1A.

According to some demonstrative embodiments of the invention, guiding mechanism 508 may guide a detonation wire into chamber 506 via an inlet 587. An end of the detonation wire may be connected, e.g., tied, to in proximity to the other end of the invertible sleeve.

According to some demonstrative embodiments of the invention, chamber 506 may be able to contain an invertible sleeve. For example, an interior of chamber 506 may be able to contain a sleeve cartridge, e.g., as described below.

Figure 5H:
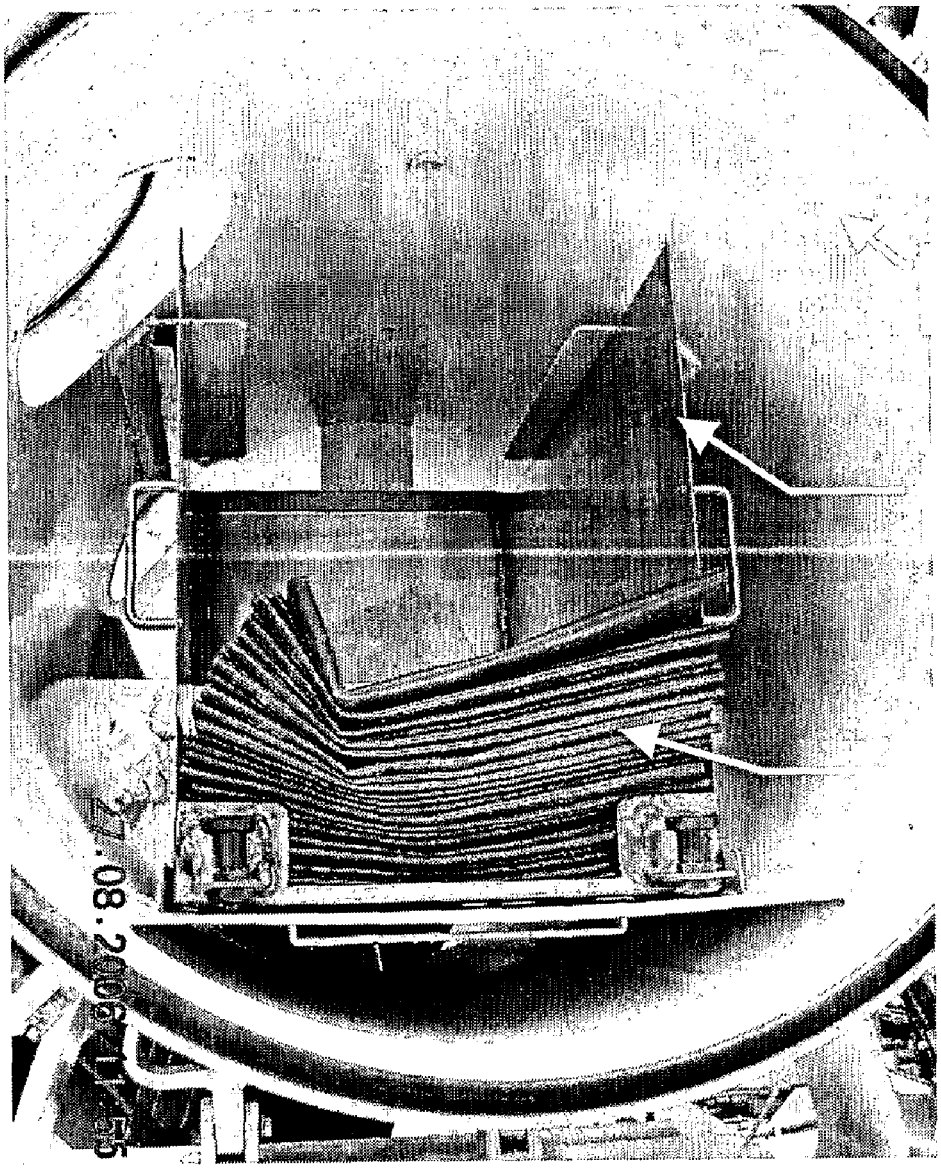
FIG. 5H depicts a sleeve cartridge installed within the pressurizer assembly of FIGS. 5A-5E, in accordance with some demonstrative embodiments of the invention.

FIG. 5H depicts an invertible sleeve cartridge 591 installed within an interior 593 of chamber 506, in accordance with some demonstrative embodiments of the invention. As shown in FIG. 5H, cartridge 591 may contain an invertible sleeve 592 at an unexpanded state.

According to some demonstrative embodiments of the invention, pressurizer 500 may also include a pressure gauge 504 to measure the pressure within pressurizer 500.

According to some demonstrative embodiments of the invention, chamber 506 may have a length of, for example, between 1000 and 12000 millimeters (mm), e.g., approximately 1141 mm. Chamber 506 may have an inner volume of approximately 30 liters.

Reference is now made to FIG. 6A, which depicts a detachable connector assembly 600, in accordance with one demonstrative embodiment of the invention. Although embodiments of the invention are not limited in this respect, according to some demonstrative embodiments connector assembly 600 may perform the functionality of connector 114 (FIG. 1A).

According to some demonstrative embodiments of the invention, connector assembly 600 may include a connection ring 604, a conical plug 606, and a clip 610. A first end 607 of cap 606 may have a diameter smaller than an inner diameter of ring 604, and a second end 609 of cap 606 may have a diameter bigger than the inner diameter of ring 604. Ring 604 may include a groove 611 having a width substantially equal to a width of clip 610.

Reference is also made to FIGS. 6B, 6C, and 6D, which depict three respective stages of connecting an end of an invertible sleeve 608 to a hose 602 using the connector assembly of FIG. 6A.

As shown in FIG. 6B, conical cap 606 may be inserted into hose 602. For example, cap 606 may be tightly inserted into hose 602 such that end 609 of cap 602 protrudes from hose 602. Ring 604 may be inserted over hose 602, e.g., at a distance of at least 5 centimeters (cm) away from the end of hose 602.

As shown in FIG. 6C, clip 610 may be inserted over sleeve 608, for example, at least 15 cm away from the end of sleeve 608.

As shown in FIG. 6D, hose 602 may be inserted into sleeve 608 such that, for example, clip 610 is positioned substantially within groove 611. Clip 610 may then be tightened to secure sleeve 608 to ring 604. As a result, sleeve 608, which is secured to ring 604, may be secured to hose 602 by cap 609.

According to some demonstrative embodiments of the invention, cap 606 may be ejected from hose 602, for example, by a pressure applied via hose 602, e.g., as described above. After cap 609 has been ejected, ring 604, which may remain secured to sleeve 608, may be free to move apart from hose 602.

FIG. 6E depicts sleeve 608 secured to ring 604, e.g., after ring 604 is detached from hose 602.

Figure 7A:
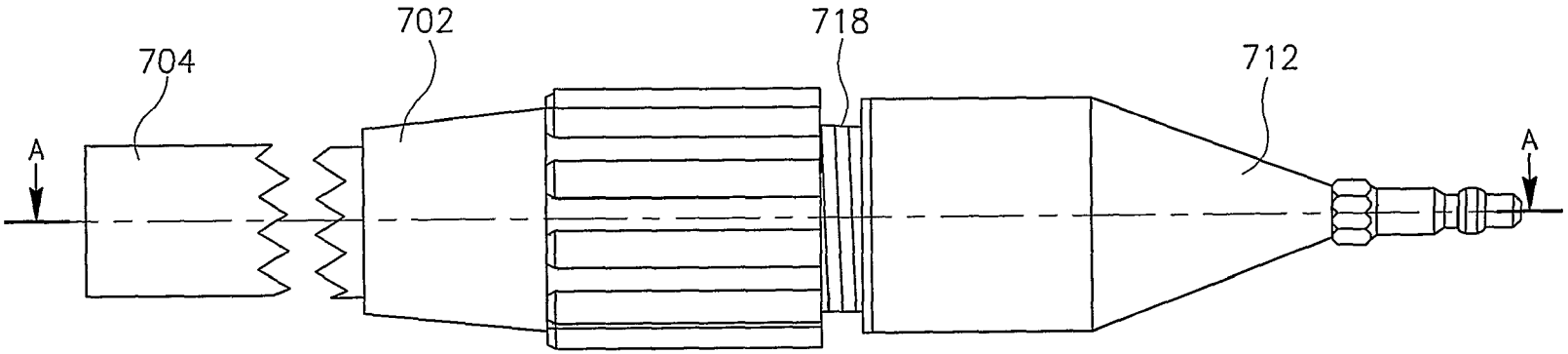
FIG. 7A is a schematic illustration of a top view of a connector assembly, in accordance with another demonstrative embodiment of the invention.
Figure 7B:
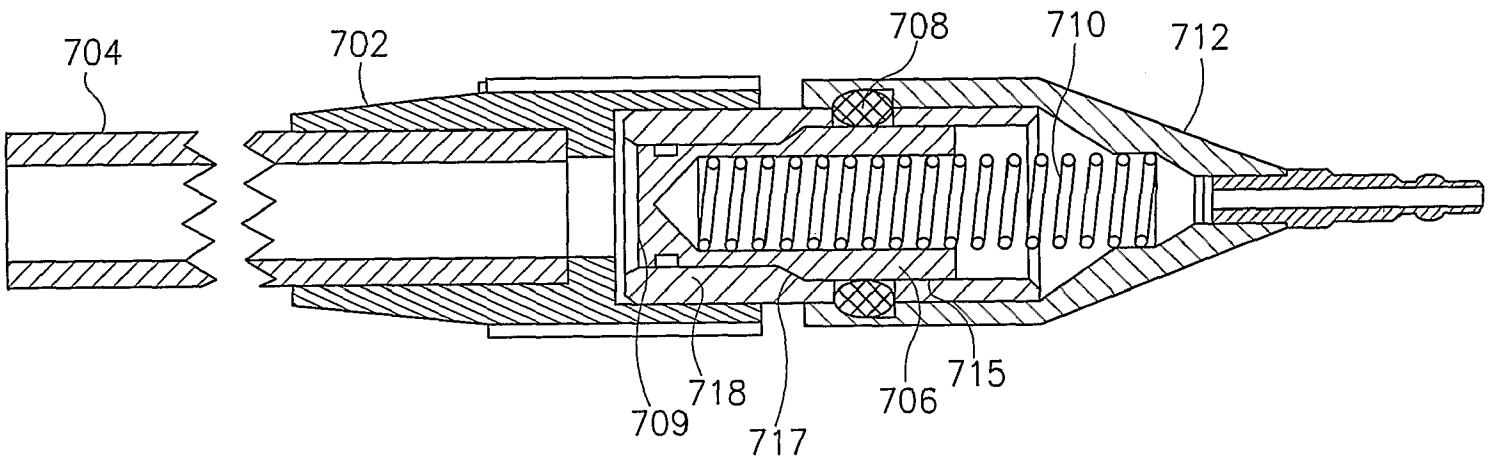
FIG. 7B is a schematic illustration of a cross section along a longitudinal axis of the connector assembly of FIG. 7A.

Reference is now made to FIG. 7A which schematically illustrates a top view of a connector 700; and to FIG. 7B, which schematically illustrates a cross section along an axis A-A of connector 700, in accordance with another demonstrative embodiment of the invention. Although embodiments of the invention are not limited in this respect, in some demonstrative embodiment connector 700 may perform the functionality of connector 104 (FIG. 1A).

According to some demonstrative embodiments of the invention, connector 700 may detachably attach a hose 704 to a sleeve (not shown in FIG. 7). Connector 700 may include a connector body 718, and a hose attachment 702 to attach connector body 718 to hose 704. Connector 700 may also include a piston 706 adapted to move within connector body 718 along a longitudinal axis of connector body 718. An end 709 of piston 706 may be in fluid connection with hose 704.

According to some demonstrative embodiments of the invention, connector 700 may also include a spring 710; a connector housing 712; a sleeve attachment to attach the sleeve to housing 712; and a plurality of balls, e.g., two balls 708, housed between piston 706 and housing 712. Spring 710 may force piston 706 against connector body 718 such that, for example, balls 708 which may be supported by an outer surface 715 of piston 709, may maintain housing 712 in connection with connector body 718.

According to some demonstrative embodiments of the invention, a pressure may be applied to hose 704, e.g., as described above, to detach housing 712 from connector body 708. For example, the pressure may be applied to surface 709 in order to force piston 706 to compress spring 710 until, for example, a cavity 717 in piston 706 is aligned with balls 708, which in turn may fall into cavity 717. As a result, connector housing 712 may be free to detach from connector body 718. Accordingly, the sleeve, which may be attached to connector housing 712, may be detached from hose 704, which may be attached to connector body 718.

Figure 8:
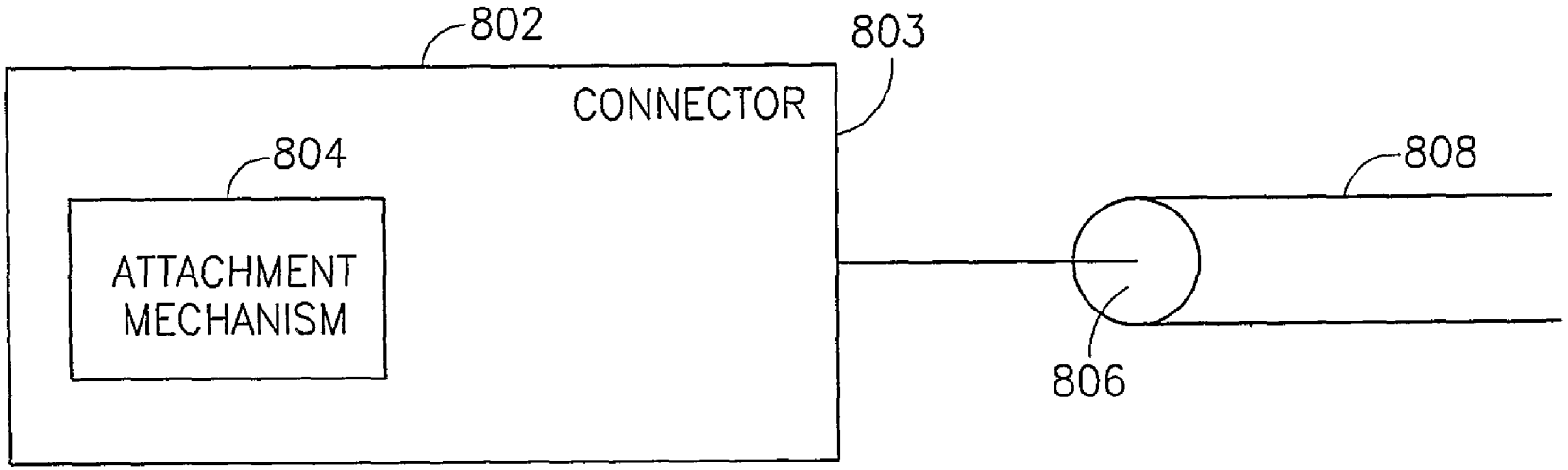
FIG. 8 is a schematic illustration of a detachable connector having an attachment mechanism, in accordance with some demonstrative embodiments of the invention.

Reference is now made to FIG. 8, which schematically illustrates a connector 802 having an attachment mechanism 804, in accordance with some demonstrative embodiments of the invention. Although embodiments of the invention are not limited in this respect connector 802 may perform the functionality of connector 104 (FIG. 1A), connector 600 (FIG. 6) and/or connector 700 (FIG. 7). Attachment mechanism 804 may include any suitable anchor and/or attachment to attach connector 802 to an object, for example, upon applying a pressure to an end 803 of connector 802, e.g., when detaching connector 802 from a hose, as described above. Connector 802 may also be attached to a pulley 806 holding a deployment line 808.

Figure 9A:
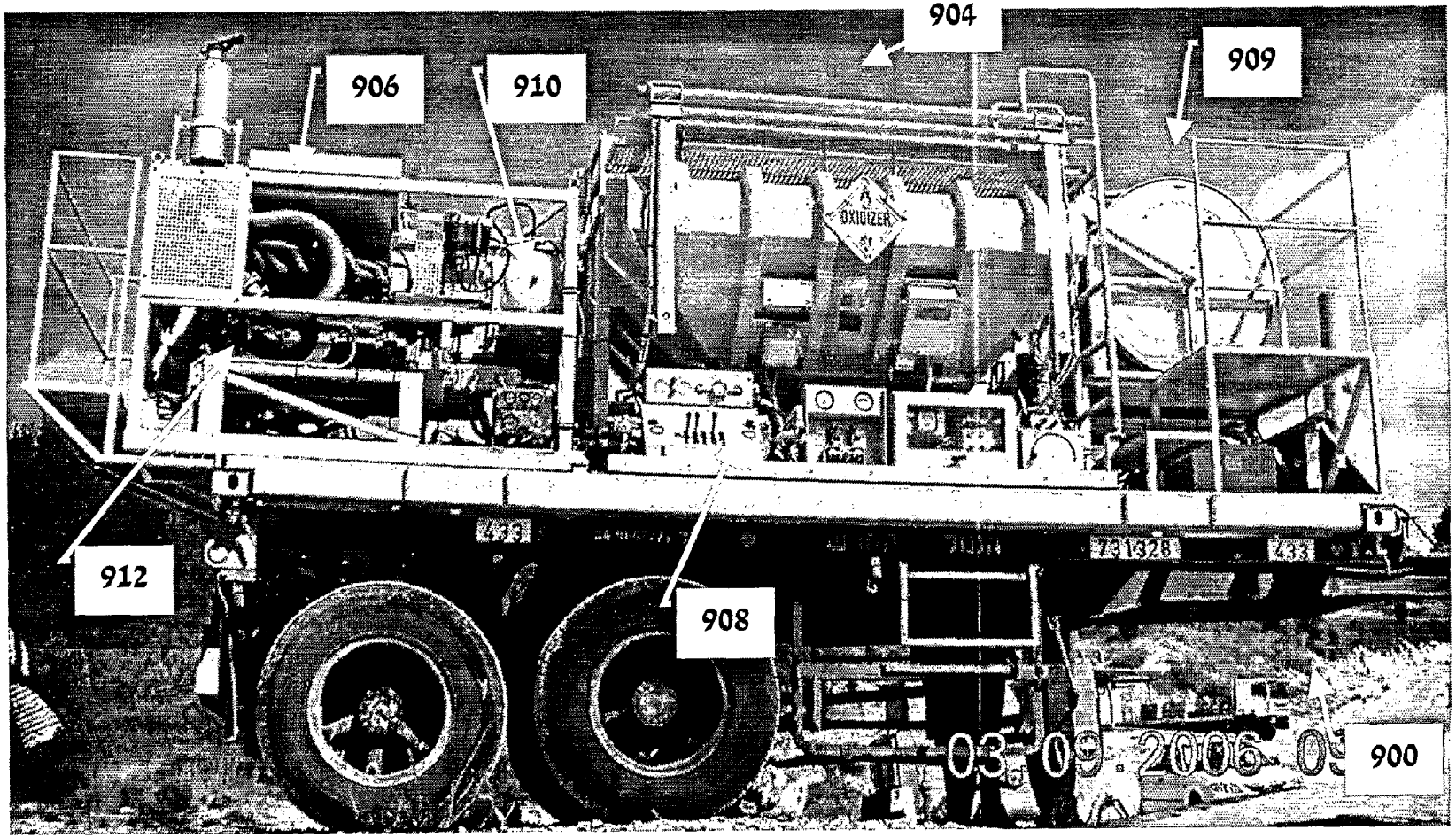
FIGS. 9A and 9B depict first and second side-views of a transportable deployment system, in accordance with some demonstrative embodiments of the invention.
Figure 9B:
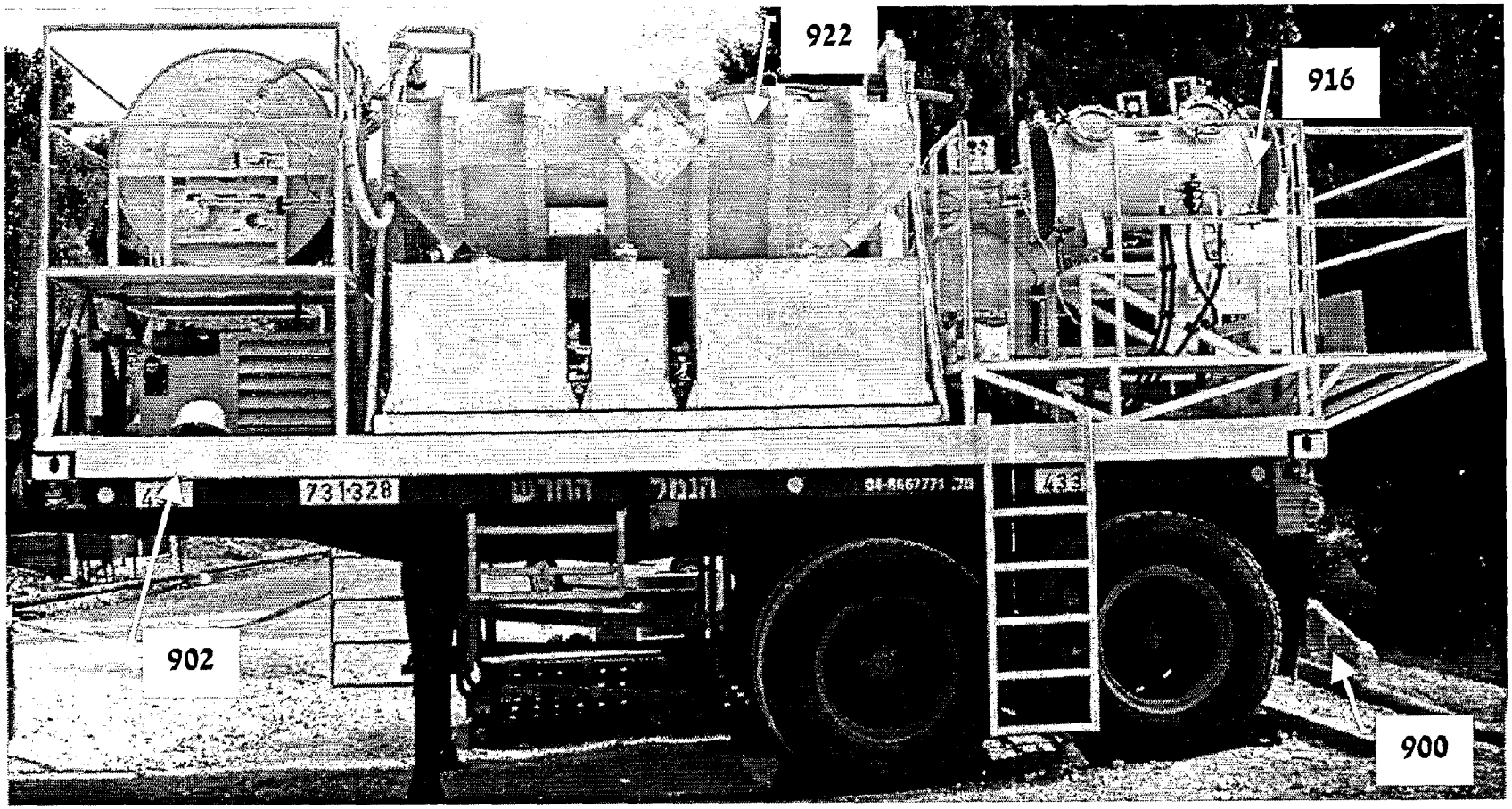

Reference is made to FIGS. 9A and 9B, which depict first and second side-views of a transportable deployment system 900, in accordance with some demonstrative embodiments of the invention. Although embodiments of the invention are not limited in this respect, according to some demonstrative embodiments of the invention system 900 may be implemented to deploy a fluid explosive, for example, an emulsion explosive.

According to some demonstrative embodiments, system 900 may include a fluid explosive generator 904, a deployment system 916, and/or a power module 906, installed on a trailer 902, which may be towed by a suitable vehicle.

According to some demonstrative embodiments, deployment system 916 may include a pressurizer, e.g., pressurizer 102 (FIG. 1A), to expand a sleeve, e.g., sleeve 104 (FIG. 1), connected to a hose, e.g., hose 116 (FIG. 1A), for example, as described above.

According to some demonstrative embodiments, fluid explosive generator 904 may include any suitable system to provide a fluid explosive to be deployed by deployment system 916. For example, fluid explosive generator 904 may include the MP1000 emulsion explosive generator. System 900 may also include a matrix reservoir 922 to accommodate an emulsion matrix, e.g., the emulsion matrix described above, to be mixed by explosive generator 904 with one or more additives, e.g., as described above.

According to some demonstrative embodiments, system 900 may also include a hose reel 909 to hold a hose, e.g., hose 116 (FIG. 1A), to be provided to deployment system 916, e.g., as described above. For example, reel 909 may perform the functionality of retractor 193 (FIG. 1A). Reel 909 may be operated, e.g., manually or by power module 906, to retract the hose at retraction rate v, e.g., as described above.

Power module 906 may include, for example, an engine, e.g., a suitable Diesel engine 912, to provide power to fluid explosive generator 904, and/or deployment system 916. For example, engine 912 may include the Diesel engine P/N BF6L914 available from Deutz, Germany.

According to some demonstrative embodiments, system 900 may also include an air compression system 910 to provide compressed air to deployment system 916. For example, air compression system may perform the functionality of pressure generator 120 (FIG. 1A).

According to some demonstrative embodiments, system 900 may also include a control panel 908, e.g., to control operation of fluid explosive generator 904. For example, control panel 908 may include a control panel operable in association with the MP1000 emulsion explosive generator.

Figure 10:
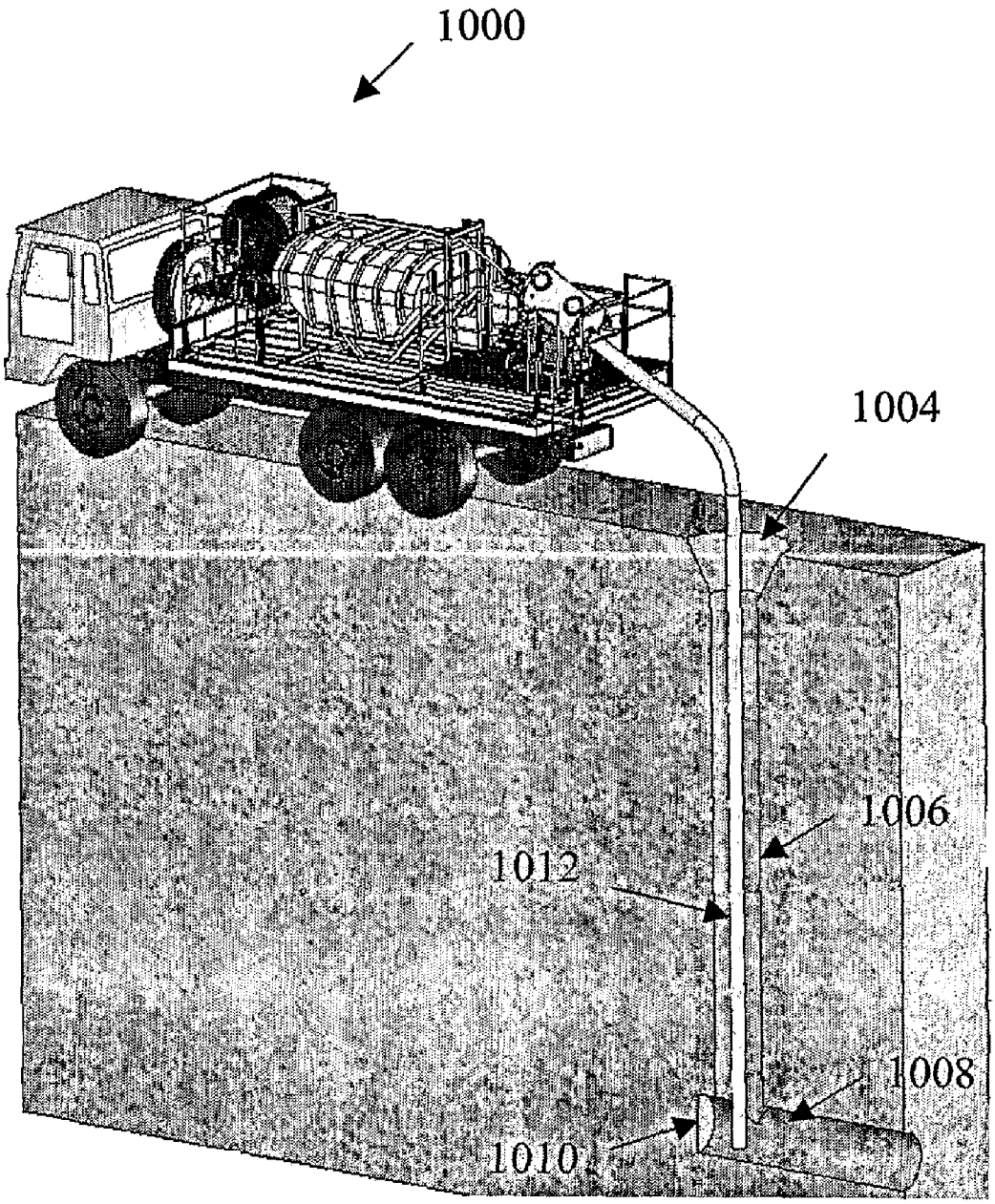
FIG. 10 schematically illustrates an implementation of a transportable deployment system to deploy a fluid explosive within a subterranean tunnel, in accordance with some demonstrative embodiments of the invention.

FIG. 10 schematically illustrates an implementation of a transportable deployment system 1000 to deploy a fluid explosive within a subterranean tunnel 1008, in accordance with some demonstrative embodiments of the invention.

According to some demonstrative embodiments of the invention, transportable deployment system may perform the functionality of transportable deployment system 900, as described above with reference to FIGS. 9A and 9B.

According to some demonstrative embodiments of the invention, system 1000 may be implemented to deploy fluid explosive, e.g., the emulsion explosive described above, within tunnel 1008. Tunnel 1008 may have an inlet 1010, which may be accessible, for example, via a vertical shaft 1006 having a ground level inlet 1004.

According to some demonstrative embodiments of the invention, a first end of an invertible sleeve 1012 may be introduced into shaft opening 1004, while a second end of the sleeve may be connected to a hose (not shown in FIG. 1), e.g., as described above. Sleeve 1012 may be expanded, e.g., as described above with reference to FIG. 2, to guide the hose within shaft 1006, and via tunnel inlet 1010 to a location 1013 within tunnel 1008. The hose may be detached from sleeve 1012; and the fluid explosive may be introduced into the hose by system 1000 and deployed at one or more locations within tunnel 1008, e.g., as described above.

Embodiments of the present invention may be implemented by software, by hardware, or by any combination of software and/or hardware as may be suitable for specific applications or in accordance with specific design requirements. Embodiments of the present invention may include units and sub-units, which may be separate of each other or combined together, in whole or in part, and may be implemented using specific, multi-purpose or general processors, or devices as are known in the art. Some embodiments of the present invention may include buffers, registers, storage units and/or memory units, for temporary or long-term storage of data and/or in order to facilitate the operation of a specific embodiment.

While certain features of the invention have been illustrated and described herein, many modifications, substitutions, changes, and equivalents may occur to those of ordinary skill in the art. It is, therefore, to be understood that the appended claims are intended to cover all such modifications and changes as fall within the true spirit of the invention.

What is claimed is:

1. A system for deploying a payload, the system comprising:

an invertible sleeve capable of being expanded in an inside-out manner;

a pressurizer having an outlet pipe, said sleeve being positionable within said pressurizer and a first end of said sleeve being able to be passed through and folded back onto said outlet pipe thereby to connect said first end to said outlet pipe, said pressurizer to apply a pressure to an inner fold of said sleeve; and a payload conveyer to convey said payload, wherein said payload conveyer is detachably connectable to a second end of said sleeve, said sleeve to pull said payload conveyor to a target.

2. The system of claim 1, wherein said payload comprises a fluid substance, and wherein said payload conveyer comprises a hose.

3. The system of claim 2 comprising a detachable connector to be connected to said second end of said sleeve and an end of said hose, and to be detached from the end of said hose.

4. The system of claim 3, wherein said connector is to be detached from the end of said hose when a predefined pressure is applied through said hose.

5. The system of claim 2, wherein said fluid substance comprises a fluid explosive.

6. The system of claim 5, wherein said fluid explosive comprises an emulsion explosive.

7. The system of claim 6, wherein a diameter of said sleeve is equal to or bigger than a critical diameter of said emulsion explosive.

8. The system of claim 2, wherein said fluid substance comprises a viscous substance having a viscosity of at least 15,000 centipoises.

9. The system of claim 1, wherein said payload conveyer comprises a deployment line.

10. The system of claim 9 comprising a detachable connector to be connected to said deployment line and said second end of said sleeve, and to be detached from said second end of said sleeve.

11. The system of claim 10, wherein said connector comprises an attachment mechanism to attach said connector to an object.

12. The system of claim 1, wherein said sleeve has a length of at least 25 meters.

13. A method of deploying a payload, the method comprising:

positioning an expandable sleeve within a pressurizer having an outlet pipe;

passing a first end of said sleeve through and folding it back onto said outlet pipe thereby to connect said first end to said outlet pipe;

connecting a second end of an invertible sleeve to a payload conveyer;

applying pressure to an inner fold of said sleeve, thereby to expand said sleeve in an inside-out manner, said sleeve to pull said payload conveyor to a target;

detaching said payload conveyer from said second end of said sleeve; and deploying said payload via said payload conveyer.

14. The method of claim 13, wherein said payload conveyer comprises a hose and wherein deploying said payload comprises deploying a fluid substance through said hose.

15. The method of claim 14 comprising retracting said hose.

16. The method of claim 14, wherein deploying said fluid substance comprises deploying a fluid explosive.

17. The method of claim 15, wherein deploying said fluid explosive comprises deploying an emulsion explosive.

18. The method of claim 15 comprising connecting to said second end of said sleeve a detonation wire to detonate said explosive fluid.

19. The method of claim 14, wherein detaching said payload conveyer from said sleeve comprises applying a pressure through said hose.

20. The method of claim 13, wherein said payload conveyer comprises a deployment line, and wherein deploying said payload comprises deploying said payload over said deployment line.

21. The method of claim 20 comprising attaching said deployment line to an object after expanding said sleeve.

22. The method of claim 13, wherein connecting said second end of the sleeve to the payload conveyer comprises connecting the second end of the sleeve and the payload conveyer to a connector, and wherein detaching said payload conveyer from said second end of said sleeve comprises detaching said connector from at least one of said second end of said sleeve and the payload conveyer.

23. The method of claim 13, wherein expanding said sleeve comprises expanding said sleeve within a subterranean tunnel.

24. The method of claim 13, wherein expanding said sleeve comprises expanding said sleeve aboveground.

25. The method of claim 13, wherein deploying said payload comprises deploying said payload at one or more locations along an expansion path of said sleeve.

26. The method of claim 13, wherein deploying said payload comprises deploying said payload externally to said sleeve.

27. The method of claim 13, wherein deploying said payload comprises deploying said payload within said sleeve.

* * * * *